US008249793B2

(12) United States Patent
Miyashita et al.

(10) Patent No.: US 8,249,793 B2
(45) Date of Patent: Aug. 21, 2012

(54) AIR-FUEL RATIO CONTROL APPARATUS AND AIR-FUEL RATIO CONTROL METHOD FOR INTERNAL COMBUSTION ENGINE

(75) Inventors: Shigeki Miyashita, Susono (JP); Kei Masuda, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 311 days.

(21) Appl. No.: 12/670,171

(22) PCT Filed: Oct. 22, 2008

(86) PCT No.: PCT/IB2008/002814

§ 371 (c)(1),
(2), (4) Date: Jan. 22, 2010

(87) PCT Pub. No.: WO2009/053814

PCT Pub. Date: Apr. 30, 2009

(65) Prior Publication Data

US 2010/0204904 A1 Aug. 12, 2010

(30) Foreign Application Priority Data

Oct. 24, 2007 (JP) ..... 2007-275974

(51) Int. Cl.
*F02D 41/00* (2006.01)

(52) U.S. Cl. ..... 701/103; 701/109; 123/674; 60/285

(58) Field of Classification Search ..... 123/672–674; 701/103–105, 109; 60/285–286
See application file for complete search history.

(56) References Cited

U.S. PATENT DOCUMENTS

| | | | | |
|---|---|---|---|---|
| 4,878,473 | A * | 11/1989 | Nakaniwa et al. | 123/691 |
| 4,915,080 | A * | 4/1990 | Nakaniwa et al. | 123/691 |
| 6,292,739 | B1 * | 9/2001 | Yasui et al. | 701/109 |
| 6,301,878 | B1 | 10/2001 | Zhang et al. | |
| 2002/0069640 | A1 | 6/2002 | Irisawa et al. | |
| 2004/0103642 | A1 | 6/2004 | Rosel et al. | |

FOREIGN PATENT DOCUMENTS

| | | |
|---|---|---|
| DE | 199 29 042 | 12/2000 |
| DE | 100 14 238 | 9/2001 |
| EP | 1 213 460 | 6/2002 |
| JP | 2 293655 | 12/1990 |
| JP | 5 149172 | 6/1993 |
| JP | 8 158917 | 6/1996 |
| JP | 10 68346 | 3/1998 |
| JP | 2002 276419 | 9/2002 |
| JP | 2005 48711 | 2/2005 |
| JP | 2005 120869 | 5/2005 |

* cited by examiner

*Primary Examiner* — Hai Huynh
(74) *Attorney, Agent, or Firm* — Oblon, Spivak, McClelland, Maier & Neustadt, L.L.P.

(57) ABSTRACT

An amount of fuel injected into an internal combustion engine is controlled to adjust an air-fuel ratio. An air-fuel ratio sensor is disposed upstream of a three-way catalyst. An ammonia sensor is disposed downstream of the three-way catalyst. Main feedback control based on the air-fuel ratio sensor is performed such that the air-fuel ratio of exhaust gas becomes close to a target air-fuel ratio in the neighborhood of a stoichiometric air-fuel ratio. Sub-feedback control is performed on the basis of an output value of the ammonia sensor.

12 Claims, 13 Drawing Sheets

| | $O_2$ SENSOR | AMMONIA SENSOR |
|---|---|---|
| ADVANTAGE | HIGH ABSOLUTE ACCURACY AND GOOD RESPONSIVENESS | LINEAR OUTPUT POSSIBLE |
| DISADVANTAGE | NO LINEARITY AND DECREASE IN OUTPUT IN DETERIORATED STATE | NO ABSOLUTE ACCURACY, BAD RESPONSIVENESS, AND DISCRIMINATION FROM NOX |

AIR-FUEL RATIO CONTROL APPARATUS AND AIR-FUEL RATIO CONTROL METHOD FOR INTERNAL COMBUSTION ENGINE

BACKGROUND OF THE INVENTION

1. Field of the Invention

The invention relates to an air-fuel ratio control apparatus for an internal combustion engine, and more particularly, to an air-fuel ratio control apparatus and an air-fuel ratio control method for an internal combustion engine that perform air-fuel ratio feedback control on the basis of a state of exhaust gas.

2. Description of the Related Art

As disclosed in Japanese Patent Application Publication No. 2002-276419 (JP-A-2002-276419), there is known a system in which an ammonia sensor is disposed in an exhaust passage of an internal combustion engine. In this system, the ammonia sensor is disposed at a post-stage of a catalyst disposed in the exhaust passage. Further, together with the ammonia sensor, an oxygen sensor is disposed at the post-stage of the catalyst.

NOx are likely to be contained in exhaust gas of the internal combustion engine when the air-fuel ratio of exhaust gas is lean. Thus, when the air-fuel ratio of exhaust gas continues to be lean, NOx may flow out to the post-stage of the catalyst. On the other hand, under a situation where the air-fuel ratio of exhaust gas is rich, NH3 (ammonia) is likely to be produced through a reaction of nitrogen in exhaust gas with hydrogen. Thus, under the situation where the air-fuel ratio of exhaust gas is rich, NH3 may be discharged to the post-stage of the catalyst.

The ammonia sensor is sensitive to NOx as well as NH3. Thus, the ammonia sensor disposed at the post-stage of the catalyst outputs a value corresponding to the concentration of NH3 under a rich atmosphere, and on the other hand, outputs a value corresponding to the concentration of NOx under a lean atmosphere.

The aforementioned system determines, on the basis of the output of the oxygen sensor disposed downstream of the catalyst, whether the air-fuel ratio of exhaust gas is rich or lean. Then, when the ammonia sensor outputs a value larger than a criterial value under a situation where the air-fuel ratio of exhaust gas is rich, this system determines that a large amount of NH3 has been generated, and attempts to make the air-fuel ratio lean. Further, when the ammonia sensor outputs a value larger than the criterial value under a situation where the air-fuel ratio of exhaust gas is lean, this system determines that a large amount of NOx has been generated, and attempts to make the air-fuel ratio rich.

According to the aforementioned processing, the air-fuel ratio of the internal combustion engine can be controlled such that the amounts of NH3 and NOx flowing out to a region downstream of the catalyst become sufficiently small. Thus, this system can ensure that the internal combustion engine acquires good emission properties.

However, for the first time when the ammonia sensor outputs a value larger than the criterial value under a lean atmosphere, the aforementioned system determines that the air-fuel ratio is deviant to a lean side, and makes the air-fuel ratio rich. According to this control, a certain amount of NOx inevitably flows out to the region downstream of the catalyst. In this respect, the aforementioned system leaves room for further improvement from the standpoint of the suppression of the discharge amount of NOx.

SUMMARY OF THE INVENTION

The invention provides an air-fuel ratio control apparatus for an internal combustion engine that can sufficiently suppress the amount of NOx discharged to a region downstream of a catalyst.

A first aspect of the invention relates to an air-fuel ratio control apparatus for an internal combustion engine that is equipped with an air-fuel ratio adjustment mechanism for adjusting an air-fuel ratio of the internal combustion engine, exhaust gas air-fuel ratio detection means for detecting an air-fuel ratio of exhaust gas, first feedback means for subjecting the air-fuel ratio adjustment mechanism to first feedback control such that the air-fuel ratio of exhaust gas becomes close to a target air-fuel ratio in a neighborhood of a stoichiometric air-fuel ratio, an ammonia sensor disposed in an exhaust system of the internal combustion engine, and second feedback means for subjecting the air-fuel ratio adjustment mechanism to second feedback control based on an output value of the ammonia sensor.

According to the foregoing aspect of the invention, the air-fuel ratio of exhaust gas can be controlled to the value in the neighborhood of the stoichiometric air-fuel ratio by the first feedback means. Furthermore, the air-fuel ratio of exhaust gas can be finely adjusted by the second feedback means. The second feedback means performs the second feedback control on the basis of an output of the ammonia sensor. In the neighborhood of the stoichiometric air-fuel ratio, the ammonia sensor outputs a linear value for the concentration of NH3. Further, in an air-fuel ratio range on a rich side with respect to an air-fuel ratio to which an oxygen sensor is sensitive, the ammonia sensor outputs a linear value for the concentration of NH3. Thus, according to the second feedback means, a control target of the air-fuel ratio can be shifted to the rich side in comparison with feedback control based on the output of the oxygen sensor. The amount of NOx in exhaust gas abruptly increases even when the air-fuel ratio of exhaust gas becomes slightly lean with respect to the stoichiometric air-fuel ratio. On the other hand, the amounts of HC and CO in exhaust gas do not very abruptly increase even when the air-fuel ratio of exhaust gas deviates to the rich side in the neighborhood of the stoichiometric air-fuel ratio. Thus, if the control target of the air-fuel ratio can be made slightly richer than the air-fuel ratio where the output of the oxygen sensor abruptly changes, the emission properties of the internal combustion engine can be improved as a whole. The aforementioned requirement can be met by the second feedback means. Therefore, the emission properties of the internal combustion engine can be improved as a whole, in comparison with a case where the air-fuel ratio is finely adjusted using the oxygen sensor.

Further, the air-fuel ratio control apparatus may be equipped with a catalyst so disposed in the exhaust system as to be located upstream of the ammonia sensor. The exhaust gas air-fuel ratio detection means may be equipped with an air-fuel ratio sensor disposed upstream of the catalyst. The first feedback means may perform the first feedback control on a basis of an output of the air-fuel ratio sensor.

According to the foregoing aspect of the invention, the first feedback control can be performed on the basis of the output of the air-fuel ratio sensor disposed upstream of the catalyst. Thus, through the first feedback control, the air-fuel ratio at the stage where exhaust gas flows into the catalyst can be controlled to a value in the neighborhood of the target air-fuel ratio. Further, the second feedback control can be performed on the basis of the output of the ammonia sensor disposed downstream of the catalyst. Thus, through the second feedback control, the air-fuel ratio can be finely adjusted such that desirable emission properties are obtained downstream of the catalyst.

Further, the air-fuel ratio control apparatus may be equipped with operation state detection means for detecting an operation state of the internal combustion engine. The second feedback means may be equipped with control parameter setting means for setting a control parameter of the air-fuel ratio on a basis of a result of a comparison between an output of the ammonia sensor and an ammonia target value, and target value change means for setting the ammonia target value to a rich-side target value under fulfillment of a high-load operation condition and setting the ammonia target value to a lean-side target value, which is leaner than the rich-side target value, under fulfillment of a low-load operation condition.

According to the aforementioned setting, the ammonia target value can be set on the rich side during high-load operation. During high-load operation, components such as NOx, HC, CO, and the like are likely to be discharged. When the ammonia target value is set on the rich side in this situation, HC and CO become more likely to be generated, but the generation amount of NOx can be suppressed. During high-load operation, the catalyst is sufficiently heated. Therefore, the capacity to purify HC and CO is sufficiently ensured. Thus, good emission properties can be realized during high-load operation. Further, the ammonia target value is set on the lean side during low-load operation. During low-load operation, the capacity of the catalyst to purify HC and CO is likely to decrease. When the ammonia target value is set on the lean side under this situation, the generation amounts of HC and CO are suppressed, and hence the discharge of HC and CO can be prevented. Further, during low-load operation, the generation amount of NOx is small, and hence the discharge of an excessive amount of NOx does not occur even when the ammonia target value is set on the lean side. Due to the reason described above, the internal combustion engine can be made to acquire good emission properties.

Further, the second feedback means may be equipped with comparison result reflection means for feeding a result of a comparison between an output of the ammonia sensor and an ammonia target value back to the air-fuel ratio with a predetermined gain, and gain setting means for increasing the gain as an amount of divergence of the output of the ammonia sensor from the ammonia target value increases.

According to the aforementioned setting, the amount of divergence of the output of the ammonia sensor from the ammonia target value can be reflected on the feedback gain. Thus, the accuracy and responsiveness of the second feedback control can be made compatible.

Further, the air-fuel ratio control apparatus may further be equipped with a catalyst so disposed in the exhaust system as to be located upstream of the ammonia sensor, and an oxygen sensor disposed downstream of the catalyst. The exhaust gas air-fuel ratio detection means may be equipped with an air-fuel ratio sensor disposed upstream of the catalyst, and the first feedback means may perform the first feedback control on a basis of an output of the air-fuel ratio sensor. Further, the air-fuel ratio control apparatus may further be equipped with third feedback means for subjecting the air-fuel ratio adjustment mechanism to second feedback control based on output values of the ammonia sensor and the oxygen sensor or an output value of the oxygen sensor, and second feedback selection means for selectively actuating the second feedback means and the third feedback means.

According to the aforementioned setting, the first feedback control can be performed on the basis of the output of the air-fuel ratio sensor located upstream of the catalyst, and the second feedback control can be performed on the basis of at least one of the output of the ammonia sensor located downstream of the catalyst and the output of the oxygen sensor located downstream of the catalyst. The two sensor outputs can be used as the base of the second feedback control. Therefore, high control accuracy can be realized.

Further, the air-fuel ratio control apparatus may further be equipped with operation state detection means for detecting an operation state of the internal combustion engine. The second feedback selection means may select the second feedback means as actuation means under fulfillment of a high-load operation condition, and select the third feedback means as actuation means under fulfillment of a low-load operation condition.

According to the aforementioned setting, during high-load operation, the second feedback control can be performed on the basis of the output of the ammonia sensor. When the second feedback control is performed on the basis of the output of the ammonia sensor, the target air-fuel ratio can be shifted to the rich side in comparison with a case where the second feedback control is performed on the basis of the output of the oxygen sensor. When the target air-fuel ratio is made rich, the production amount of NOx can be suppressed. Thus, good emission properties can be realized even during high-load operation, which tends to cause the generation of a large amount of NOx. During low-load operation, the second feedback control can be performed on the basis of the output of the oxygen sensor. When the second feedback control is performed on the basis of the output of the oxygen sensor, the target air-fuel ratio can be shifted to the lean side. When the target air-fuel ratio is made lean, the generation amounts of HC and CO are suppressed. Accordingly, good emission properties can be realized even during low-load operation, which causes a decrease in the activity of the catalyst.

Further, the air-fuel ratio control apparatus may be equipped with deviation direction determination means for determining whether the air-fuel ratio of exhaust gas is deviant from the target air-fuel ratio to a rich side or to a lean side. The second feedback selection means may select the second feedback means as actuation means under a condition that it be determined that the air-fuel ratio of exhaust gas is deviant to the rich side, and select the third feedback means as actuation means under a condition that it be determined that the air-fuel ratio of exhaust gas is deviant to the lean side.

According to the aforementioned setting, when the air-fuel ratio of exhaust gas is deviant from the target air-fuel ratio to the rich side, the second feedback control is performed on the basis of the output of the ammonia sensor. The ammonia sensor is worse in responsiveness than the oxygen sensor, but on the other hand, outputs a linear value for a slightly rich air-fuel ratio that cannot be stably detected by the oxygen sensor. When the target air-fuel ratio is deviant to the rich side, the generation of a large amount of NOx is unlikely to occur, and hence, responsiveness is not required of the feedback control. In this case, good emission properties can be realized by performing the second feedback control on the basis of the output of the ammonia sensor. Further, when the air-fuel ratio of exhaust gas is deviant from the target air-fuel ratio to the lean side, the second feedback control is performed on the basis of the output of the oxygen sensor. Unlike the ammonia sensor, the oxygen sensor is not sensitive to a range richer than the stoichiometric air-fuel ratio, but on the other hand, has excellent responsiveness. When the target air-fuel ratio is deviant to the lean side, the generation of a large amount of NOx is likely to occur. The discharge amount of NOx can be sufficiently suppressed with excellent responsiveness by performing the second feedback control on the basis of the output of the oxygen sensor under the aforementioned situation.

Further, the deviation direction determination means may determine that the air-fuel ratio of exhaust gas is deviant from the target air-fuel ratio to the rich side when the output of the oxygen sensor is larger than an oxygen target value, and determine that the air-fuel ratio of exhaust gas is deviant from the target air-fuel ratio to the lean side when the output of the oxygen sensor is smaller than the oxygen target value.

According to the aforementioned setting, it can be determined, on the basis of the output of the oxygen sensor, whether the air-fuel ratio of exhaust gas is deviant from the target air-fuel ratio to the rich side or to the lean side. The oxygen sensor has high absolute accuracy and excellent responsiveness. Thus, the aforementioned determination can be accurately made with excellent responsiveness.

Further, the second feedback means may perform the second feedback control such that the output of the ammonia sensor becomes close to an ammonia target value, and the third feedback means may perform the second feedback control such that the output of the oxygen sensor becomes close to an oxygen target value. The air-fuel ratio of exhaust gas for making the output of the ammonia sensor coincident with the ammonia target value may be shifted to the rich side from the air-fuel ratio of exhaust gas for making the output of the oxygen sensor coincident with the oxygen target value.

According to the aforementioned setting, the target air-fuel ratio can be changed depending on whether the second feedback control is performed on the basis of the output of the ammonia sensor or the output of the oxygen sensor.

Further, the third feedback means may be equipped with control parameter setting means for reflecting a result of a comparison between an output of the oxygen sensor and an oxygen target value on a control parameter of the air-fuel ratio with a predetermined gain, and gain setting means for increasing the gain as an amount of divergence of the output of the oxygen sensor from the oxygen target value increases.

According to the aforementioned setting, the amount of divergence of the output of the oxygen sensor from the oxygen target value can be reflected on the feedback gain. Thus, according to the invention, the accuracy and responsiveness of the second feedback control can be made compatible.

BRIEF DESCRIPTION OF THE DRAWINGS

The foregoing and further objects, features and advantages of the invention will become apparent from the following description of embodiments with reference to the accompanying drawings, wherein like numerals are used to represent like elements and wherein.

DETAILED DESCRIPTION OF THE EMBODIMENTS

First Embodiment

Figure 1:
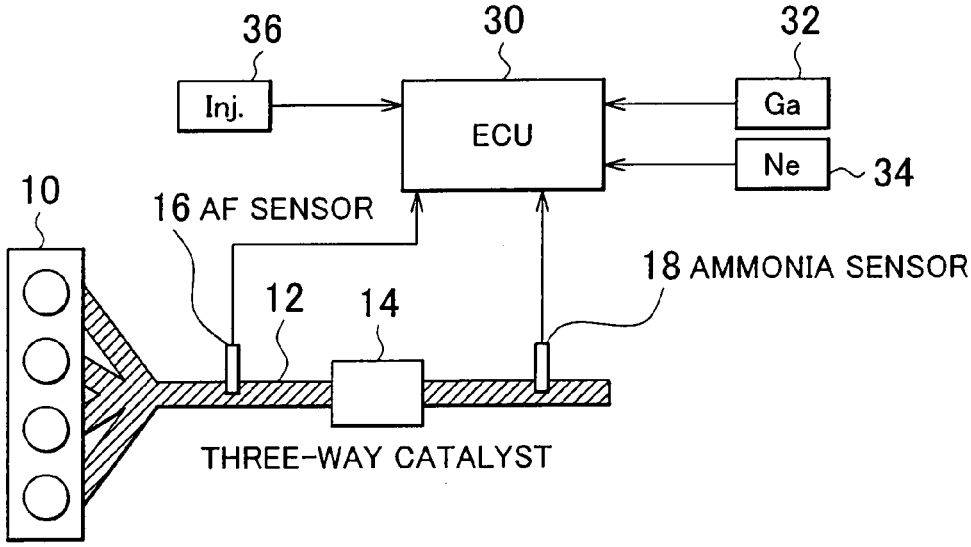
FIG. 1 is a diagram for explaining the configuration of the first embodiment of the invention.

[Configuration of First Embodiment] FIG. 1 is a diagram for explaining the configuration of the first embodiment of the invention. As shown in FIG. 1, a system according to this embodiment of the invention is equipped with an internal combustion engine 10. An exhaust passage 12 is in communication with the internal combustion engine 10. A three-way catalyst 14 is incorporated in the exhaust passage 12. An air-fuel ratio sensor 16 for detecting an air-fuel ratio of exhaust gas is disposed upstream of the three-way catalyst 14. Further, an ammonia sensor 18 is disposed downstream of the three-way catalyst 14.

An output of the air-fuel ratio sensor 12 and an output of the ammonia sensor 18 are supplied to an electronic control unit (ECU) 30. Further, an output of an airflow meter 32 for detecting an intake air amount Ga and an output of a rotational speed sensor 34 for detecting an engine rotational speed Ne are supplied to the ECU 30. Furthermore, an injector 36 for injecting fuel to an intake side of the internal combustion engine 10 is connected to the ECU 30. The ECU 30 performs feedback control of the amount of fuel injected from the injector 36 such that the air-fuel ratio of exhaust gas becomes equal to a target air-fuel ratio, on the basis of the outputs of the aforementioned various sensors.

Figure 2:
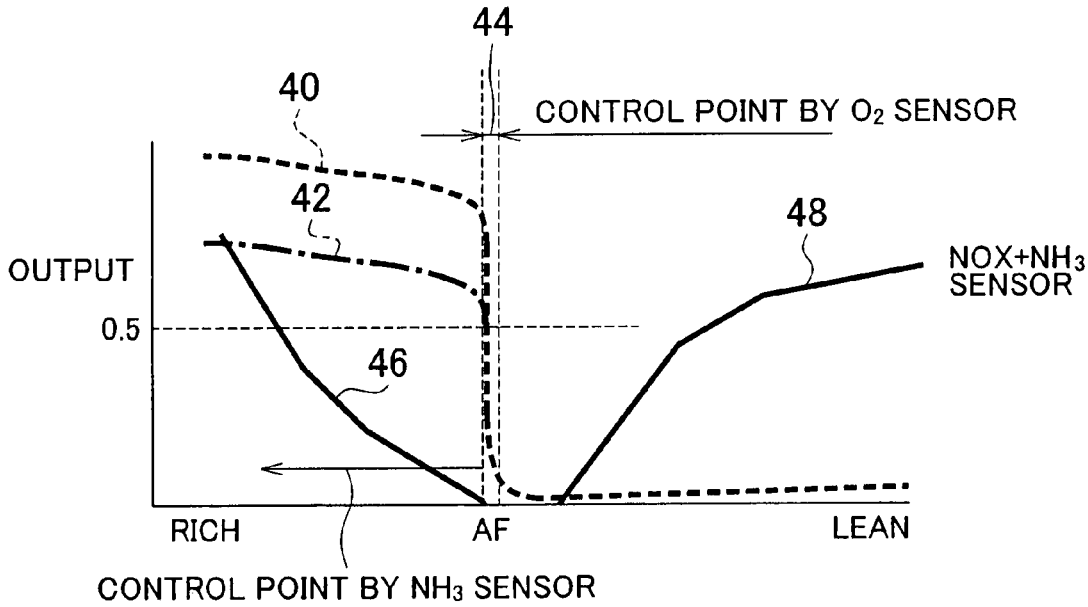
FIG. 2 is a diagram for explaining a characteristic of an ammonia sensor shown in FIG. 1 and a deterioration characteristic of an oxygen sensor.

[Characteristics of Oxygen Sensor and Ammonia Sensor] FIG. 2 is a diagram for explaining the characteristic of the ammonia sensor 18. In FIG. 2, a characteristic curve denoted by a reference numeral 40 represents an initial characteristic of an ordinary oxygen sensor. Further, a characteristic curve denoted by a reference numeral 42 represents a characteristic of an oxygen sensor after aged deterioration. The oxygen sensor generates a high output (rich output) when the air-fuel ratio is on the rich side with respect to a stoichiometric air-fuel ratio, and generates a low output (lean output) when the air-fuel ratio is on the lean side with respect to the stoichiometric air-fuel ratio. Thus, when a criterial value is set between the rich output and the lean output and compared with an output of the oxygen sensor, it can be determined whether or not the air-fuel ratio is rich or lean.

The rich output of the oxygen sensor is about 0.9 V at an initial stage (see the characteristic curve 40), but decreases to about 0.6 V in the course of aged deterioration (see the characteristic curve 42). Thus, in order to make a correct determination even after aged deterioration using the oxygen sensor, the criterial value needs to be set to about 0.5 V.

Given that an air-fuel ratio at which the inversion of the output of the oxygen sensor is detected is referred to as "an inversion air-fuel ratio", the air-fuel ratio shifts to the rich side as the criterial value increases across the inversion air-fuel ratio, and on the other hand, shifts to the lean side as the criterial value decreases across the inversion air-fuel ratio. The upper limit of the criterial value to be compared with the output of the oxygen sensor is about 0.5 V because of the reason described above. Thus, as long as the oxygen sensor is used, the behavior of the air-fuel ratio cannot be detected in a range richer than the inversion air-fuel ratio corresponding to 0.5 V.

A range denoted by a reference numeral 44 in FIG. 2 is a control range of the air-fuel ratio that can be realized by performing air-fuel ratio feedback control on the basis of the output of the oxygen sensor. The air-fuel ratio feedback control based on the output of the oxygen sensor can be realized by, for example, increasing the amount of fuel injection when the output inverts to a lean output, and on the contrary, reducing the amount of fuel injection when the output inverts to a rich output. When this control is performed, the air-fuel ratio of the internal combustion engine is maintained in a range in the neighborhood of the air-fuel ratio corresponding to 0.5 V as indicated as the range 44.

A solid line denoted by a reference numeral 46 in FIG. 2 and a solid line denoted by a reference numeral 48 in FIG. 2 both represent characteristics of the ammonia sensor 18. The ammonia sensor 18 outputs a value indicating the amount of reaction to NH3 (ammonia) and NOx in an atmosphere. When the air-fuel ratio is rich, NH3 is contained in exhaust gas. Further, the richer the air-fuel ratio becomes, the higher the concentration of NH3 in exhaust gas is likely to become. Thus, under a situation where the air-fuel ratio is rich, the richer the air-fuel ratio becomes, the larger the value output by the ammonia sensor 18 becomes, as indicated by the solid line 46.

In the case where the air-fuel ratio is lean, NOx are likely to be contained in exhaust gas. The leaner the air-fuel ratio becomes, the higher the concentration of NOx in exhaust gas becomes. Thus, in a range where the air-fuel ratio is lean, the leaner the air-fuel ratio becomes, the larger the value output by the ammonia sensor 18 becomes, as indicated by the solid line 48. Due to the reason described above, the ammonia sensor 18 outputs values corresponding to the air-fuel ratio respectively in a rich air-fuel ratio range and in a lean air-fuel ratio range. Especially, the ammonia sensor 18 outputs a value corresponding to the air-fuel ratio in a range outside the inversion air-fuel ratio of the oxygen sensor. Thus, the ammonia sensor 18 can detect the air-fuel ratio over a wider range than the oxygen sensor.

Figure 3:
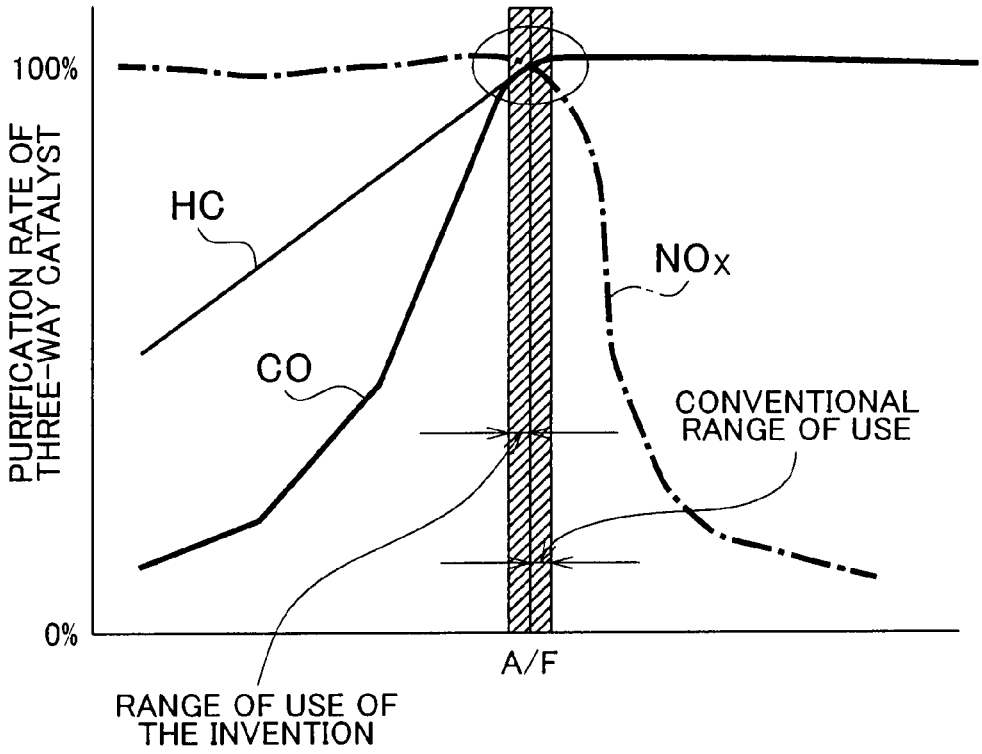
FIG. 3 is a diagram for explaining a relationship between a purification rate of a three-way catalyst and an air-fuel ratio, and a control range of the air-fuel ratio through air-fuel ratio feedback.

[Features of First Embodiment] FIG. 3 is a diagram for explaining a relationship between a purification rate of the three-way catalyst 14 and an air-fuel ratio, and a control range of the air-fuel ratio through air-fuel ratio feedback. A solid line accompanied with "HC" in FIG. 3 represents a relationship between the purification rate of the three-way catalyst 14 for HC and the air-fuel ratio. Further, a solid line accompanied with "CO" represents a relationship between the purification rate of the three-way catalyst 14 for CO and the air-fuel ratio. Furthermore, alternate long and short dash lines accompanied with "NOx" represent a relationship between the purification rate of the three-way catalyst 14 for NOx and the air-fuel ratio.

As shown in FIG. 3, the purification rate of the three-way catalyst 14 for each of HC and CO is almost 100% in the lean air-fuel ratio range. In the rich air-fuel ratio range, the richer the air-fuel ratio becomes, the lower the purification rate becomes. On the other hand, the purification rate of the three-way catalyst 14 for NOx is almost 100% in the rich air-fuel ratio range. In the lean air-fuel ratio range, the leaner the air-fuel ratio becomes, the lower the purification rate of the three-way catalyst 14 for NOx becomes. That is, the three-way catalyst 14 demonstrates a purification rate of almost 100% for all of HC, CO, and NOx when the air-fuel ratio of exhaust gas is maintained in the neighborhood of the stoichiometric air-fuel ratio. Thus, in the internal combustion engine 10, it is important to maintain the air-fuel ratio of exhaust gas in the neighborhood of the stoichiometric air-fuel ratio.

In FIG. 3, an air-fuel ratio range indicated as "RANGE OF USE OF RELATED ART" represents a control range realized by disposing an oxygen sensor downstream of the three-way catalyst 14 and performing air-fuel ratio feedback control on the basis of the output of the oxygen sensor. On the other hand, an air-fuel ratio range indicated as "RANGE OF USE OF THIS EMBODIMENT OF THE INVENTION" represents a control range realized in the system according to this embodiment of the invention where the ammonia sensor 18 is provided downstream of the three-way catalyst 14.

The system according to this embodiment of the invention performs a combination of main air-fuel ratio feedback control based on the output of the air-fuel ratio sensor 16 disposed upstream of the three-way catalyst 14 and sub-feedback control based on the output of the ammonia sensor 18 disposed downstream of the three-way catalyst 14. The main feedback control serves to adjust the amount of fuel injection such that the air-fuel ratio of exhaust gas discharged from the internal combustion engine 10 becomes equal to the stoichiometric air-fuel ratio.

The internal combustion engine 10 is affected by the accumulation of influences of an individual difference, aged deterioration, and the like. Thus, the air-fuel ratio of exhaust gas obtained as a result of the main air-fuel ratio feedback control may deviate to the rich side or to the lean side. If this tendency continues, there will soon be a situation where rich gas or lean gas blows by in a region downstream of the three-way catalyst 14.

The aforementioned blow-by can be detected by the ammonia sensor 18 disposed downstream of the three-way catalyst 14. The sub-feedback control is intended to eliminate the deviation of the control center of the air-fuel ratio by detecting the influence of the blow-by. This sub-feedback control can be realized by, for example, correcting the amount of fuel injection in a decreasing direction when the output of the ammonia sensor 18 deviates to the rich side, and on the other hand, correcting the amount of fuel injection in an increasing direction when the output of the ammonia sensor 18 deviates to the lean side.

As described with reference to FIG. 2, the ammonia sensor 18 is sensitive to the air-fuel ratio on the side richer than the inversion air-fuel ratio of the ordinary oxygen sensor. Thus, according to the system of this embodiment of the invention, the control target of the sub-feedback control can be shifted to the rich side in comparison with a case where the oxygen sensor is disposed downstream of the three-way catalyst 14. Then, when the control target of the sub-feedback control is shifted to the rich side as described above, the air-fuel ratio of exhaust gas can be shifted to the rich side with respect to the "RANGE OF USE OF RELATED ART", as indicated as "RANGE OF USE OF THIS EMBODIMENT OF THE INVENTION" in FIG. 3.

As described above, the purification rate of the three-way catalyst 14 for NOx decreases in the lean range. On the other hand, the purification rate of the three-way catalyst for each of HC and CO decreases in the rich range. A comparison between both the purification rates shows that the purification rate for NOx tends to decrease more abruptly than the purification rate for each of HC and CO (see FIG. 3). Thus, when a comparison is made between a case where the air-fuel ratio of exhaust gas deviates to the lean side and a case where the air-fuel ratio of exhaust gas deviates to the rich side, a deterioration in emission properties tends to be more serious in the former case.

When the ammonia sensor 18 is disposed downstream of the three-way catalyst 14 to shift the control target of the sub-feedback control to the rich side, the air-fuel ratio is likely to deviate to the rich side but unlikely to deviate to the lean side. The purification rate for each of HC and CO does not abruptly decrease when the air-fuel ratio deviates to the rich side. Therefore, the increase in the discharge amount of HC or CO caused by the aforementioned shift is not appreciably large. On the other hand, when the air-fuel ratio is restrained from deviating to the lean side, the discharge amount of NOx is drastically reduced. Thus, according to the system of this embodiment of the invention, an improvement in overall emission properties can be made in comparison with the system in which the oxygen sensor is disposed downstream of the three-way catalyst 14 to perform the sub-feedback control.

Figure 4:
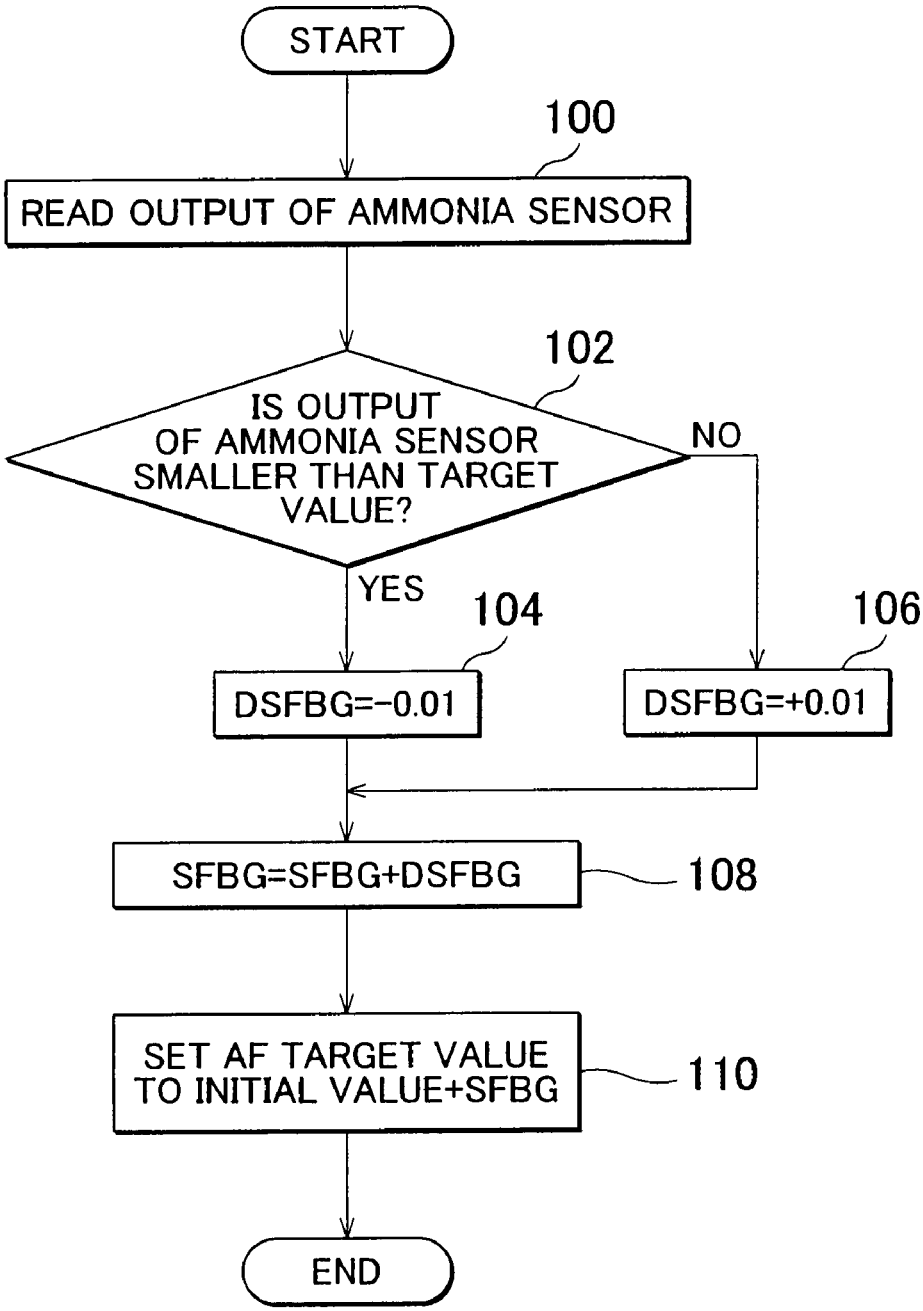
FIG. 4 is a flowchart of a routine executed in the first embodiment of the invention.

[Concrete Processings in First Embodiment] FIG. 4 is a flowchart of a routine executed by the ECU 30 to realize the sub-feedback control based on the output of the ammonia sensor 18. In addition to the routine shown in FIG. 4, the ECU 30 executes a routine for realizing the main feedback control based on the output of the air-fuel ratio sensor 16. The air-fuel ratio of exhaust gas is controlled to a value in the neighborhood of the stoichiometric air-fuel ratio through the main feedback control.

In the routine shown in FIG. 4, an output of the ammonia sensor 18 is first read (step 100). It is then determined whether or not the output of the ammonia sensor 18 is smaller than a target value (step 102).

As shown in FIG. 2, the ammonia sensor 18 outputs a value corresponding to NOx in a range where the air-fuel ratio of exhaust gas is deviant from the stoichiometric air-fuel ratio to the lean side to a certain extent. Thus, on the assumption that the air-fuel ratio of exhaust gas is maintained in the neighborhood of the stoichiometric air-fuel ratio, the ammonia sensor 18 can be considered to output a value corresponding to the concentration of NH3 in exhaust gas. In this case, the ECU 30 can determine that the smaller the output of the ammonia sensor 18 becomes, the closer the air-fuel ratio of exhaust gas becomes to the stoichiometric air-fuel ratio, and on the other hand, that the larger the output of the ammonia sensor 18 becomes, the more the air-fuel ratio of exhaust gas deviates to the rich side.

The target value used in the aforementioned step 102 corresponds to a value output by the ammonia sensor 18 under an air-fuel ratio of exhaust gas that is slightly richer than the stoichiometric air-fuel ratio (hereinafter referred to as "a rich shift stoichiometric air-fuel ratio). The rich shift stoichiometric air-fuel ratio is slightly richer than the inversion air-fuel ratio (see FIG. 2) of the oxygen sensor. Accordingly, through the processing of the aforementioned step 102, it can be determined whether or not the air-fuel ratio of exhaust gas blown by from the three-way catalyst 14 is located on the lean side with respect to the air-fuel ratio slightly richer than the inversion air-fuel ratio of the oxygen sensor.

When it is determined in the aforementioned step 102 that a condition is fulfilled, namely, that the air-fuel ratio of exhaust gas is located on the lean side with respect to the rich shift stoichiometric air-fuel ratio, a sub-feedback update amount DSFBG is set to −0.01 (step 104). On the other hand, when the condition is denied, the sub-feedback update amount DSFBG is set to 0.01 (step 106).

In the routine shown in FIG. 4, a sub-feedback learning value SFBG is then calculated according to an expression (1) shown below (step 108). It should be noted herein that SFBG on the right side of the expression (1) is SFBG calculated in the last processing cycle (this value is first set through an initial processing).

$$SFBG=SFBG+DSFBG \quad (1)$$

An AF target value is then calculated according to an expression (2) shown below (step 110). It should be noted herein that "initial value" on the right side of the expression (2) corresponds to the stoichiometric air-fuel ratio (e.g., 14.6).

$$AF\text{ target value}=\text{initial value}+SFBG \quad (2)$$

According to the aforementioned processings, when the ammonia sensor 18 detects an air-fuel ratio leaner than the rich shift stoichiometric air-fuel ratio, the AF target value is corrected to a smaller value, namely, a value on the rich side. On the other hand, when the ammonia sensor 18 detects an air-fuel ratio richer than the rich shift stoichiometric air-fuel ratio, the AF target value is corrected to a larger value, namely, a value on the lean side. Thus, through the aforementioned processing, the AF target value can be corrected such that the output of the ammonia sensor 18 becomes equal to a value corresponding to the rich shift stoichiometric air-fuel ratio.

The ECU 30 subjects the amount of fuel injection to the sub-feedback control such that the AF target value set through the aforementioned processings is realized. As a result, in the system according to this embodiment of the invention, the air-fuel ratio of exhaust gas in the internal combustion engine 10 is controlled to the air-fuel ratio range indicated as "RANGE OF USE OF THIS EMBODIMENT OF THE INVENTION" in FIG. 3. This range is shifted to the rich side from "RANGE OF USE OF RELATED ART" by the oxygen sensor. Thus, according to the system of this embodiment of the invention, more excellent emission properties can be realized than in the system in which the oxygen sensor is used to perform the sub-feedback control.

In the foregoing first embodiment of the invention, the injector 36 may correspond to "the air-fuel ratio adjustment mechanism", and the air-fuel ratio sensor 16 may correspond to "the exhaust gas air-fuel ratio detection means". Further, "the first feedback means" may be realized through the performance of the main feedback control by the ECU 30 on the basis of the output of the air-fuel ratio sensor 16. "The second feedback means" may be realized through the performance of the sub-feedback control by the ECU 30 to realize the AF target value calculated through the processing of step 110.

Second Embodiment

[Features of Second Embodiment] Next, the second embodiment of the invention will be described with reference to FIGS. 5 to 7. A system according to this embodiment of the invention can be realized by causing the ECU 30 to execute a later-described routine shown in FIG. 5 instead of the routine shown in FIG. 4 in the system according to the foregoing first embodiment of the invention.

In the system according to the foregoing first embodiment of the invention, an improvement in emission properties is made by shifting the AF target value of the sub-feedback control to the rich side, focusing attention on the fact that the purification rate of the three-way catalyst 14 tends to decrease differently for HC, CO, and NOx. The purification capacity of the three-way catalyst 14 is not always constant but changes in accordance with the load state of the internal combustion engine 10. Further, the amounts of HC, CO, and NOx discharged from the internal combustion engine 10 also change in accordance with the load state thereof. Thus, when the AF target value of the sub-feedback control is appropriately adjusted in accordance with the load state of the internal combustion engine 10, a further improvement in emission properties can be made in the region downstream of the three-way catalyst 14.

That is, when the internal combustion engine 10 is operated in the high-load range, large amounts of HC, CO, and NOx are all likely to be discharged as the air-fuel ratio fluctuates. On the other hand, during the operation in the high-load range, the three-way catalyst 14 is at a sufficiently high temperature and in a sufficiently activated state. In this case, the three-way catalyst 14 demonstrates a sufficient purification capacity for HC and CO. Under this situation, even though the discharge amounts of HC and CO slightly increase, it is desirable, from the standpoint of obtaining good emission properties, to shift the control center of the air-fuel ratio to the rich side to create a situation where the generation of a large amount of NOx is, easy to suppress.

On the other hand, when the internal combustion engine 10 is operated in the low-load range, the three-way catalyst 14 is low in temperature and has reduced activity. In this case, the purification capacity of the three-way catalyst 14 for HC and CO deteriorates. Therefore, it is undesirable to create a situation where HC and CO are likely to be discharged. On the other hand, when the load of the internal combustion engine 10 is low, the amount of NOx discharged in the lean air-fuel ratio range is not appreciably large either. In this case, with a view to improving emission properties comprehensively, it is desirable to shift the control center of the air-fuel ratio from the center during high-load operation to the lean side.

Due to the reason described above, the load state of the internal combustion engine 10 is reflected on the AF target value of the sub-feedback control. More specifically, in this system, the higher the load of the internal combustion engine 10 becomes, the more the aforementioned AF target value is shifted to the rich side. Further, the lower the load of the internal combustion engine 10 becomes, the more the aforementioned AF target value is shifted to the lean side.

Figure 5:
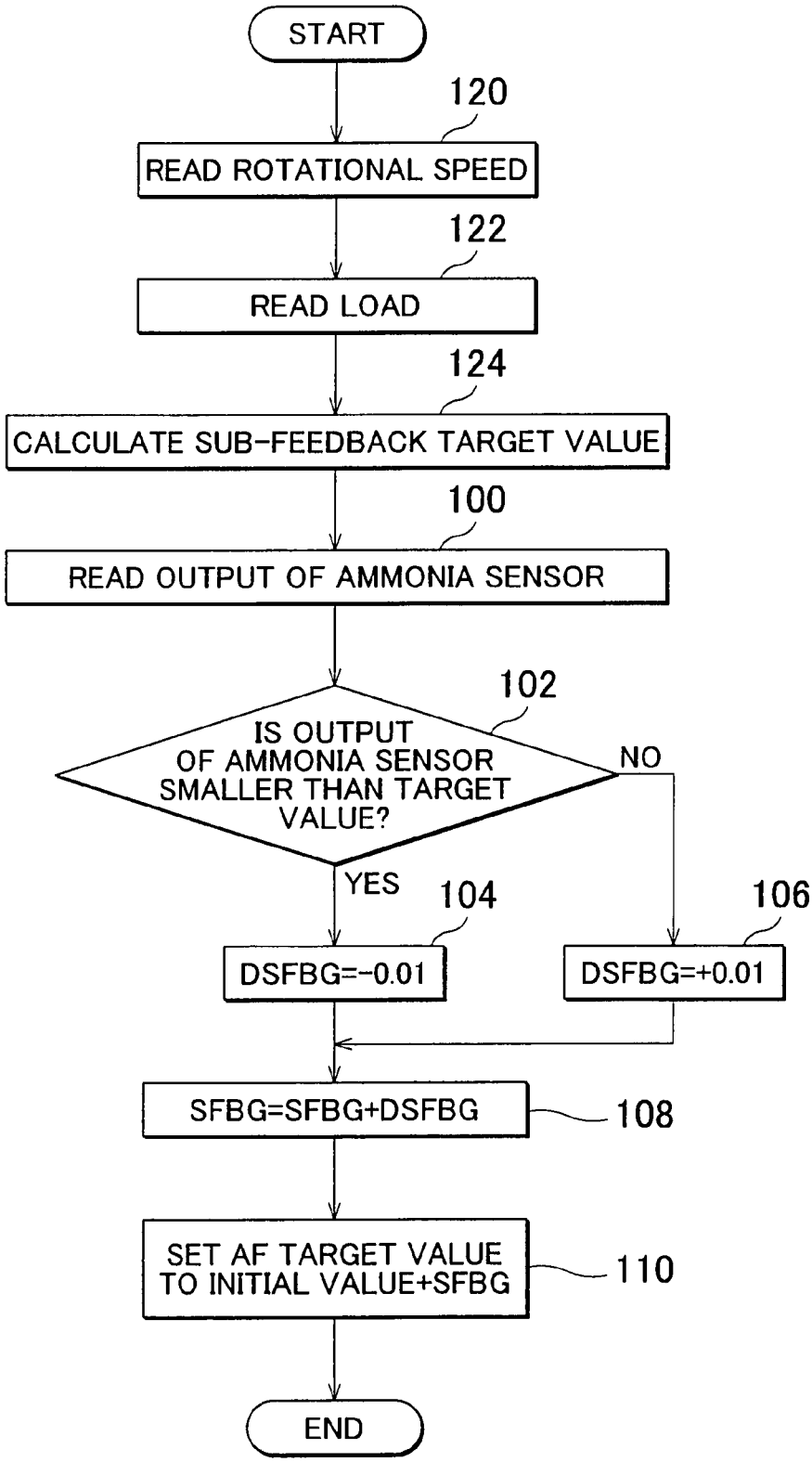
FIG. 5 is a flowchart of a routine executed in the second embodiment of the invention.

[Concrete Processings in Second Embodiment] FIG. 5 is a flowchart of a routine executed by the ECU 30 to realize the sub-feedback control in this embodiment of the invention. The routine shown in FIG. 5 is identical to the routine shown in FIG. 4 except in that steps 120 to 124 are inserted before step 100. Hereinafter, referring to FIG. 5, steps identical to those shown in FIG. 4 will be denoted by the same reference numerals, and the description of these steps will be omitted or simplified.

In the routine shown in FIG. 5, an engine rotational speed Ne is first read (step 120). The engine rotational speed Ne can be calculated on the basis of an output of the rotational speed sensor 34. A load of the internal combustion engine 10 is then read (step 122). The engine load can be calculated on the basis of the engine rotational speed Ne and the intake air amount Ga.

A sub-feedback target value, namely, an output target value of the ammonia sensor 18 is calculated (step 124). As shown in FIG. 6, the ECU 30 stores therein a map that determines the sub-feedback target value in relation to the engine rotational speed Ne and the engine load. In this case, a sub-feedback target value corresponding to a current engine rotational speed Ne and an engine load is set by referring to the map.

Figure 6:
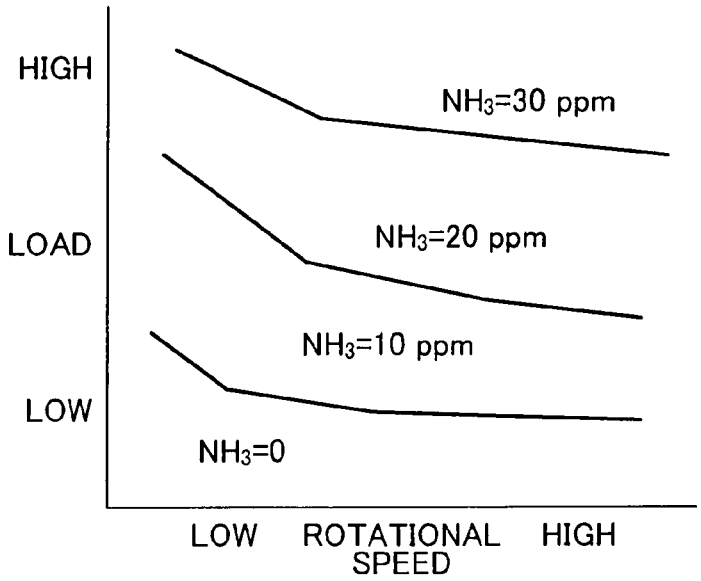
FIG. 6 is a diagram showing a map referred to in the routine shown in FIG. 5.

According to the map shown in FIG. 6, in a low-load low-rotation range, a sensor output corresponding to the concentration of ammonia=0 (NH3=0) is set as a feedback target value. In a range where the load is slightly higher and the engine rotational speed Ne is higher than in that range (hereinafter referred to as "a first intermediate-load intermediate-rotation range"), a sensor output corresponding to the concentration of ammonia=10 ppm (NH3=10 ppm) is set as the feedback target value. In a range where the load is still slightly higher and the engine rotational speed Ne is higher than in the first intermediate-load intermediate-rotation range (hereinafter referred to as "a second intermediate-load intermediate-rotation range"), a sensor output corresponding to the concentration of ammonia=20 ppm (NH3=20 ppm) is set as the feedback target value. Then, in the high-load high-rotation range, a sensor output corresponding to the concentration of ammonia=30 ppm (NH3=30 ppm) is set as the feedback target value.

As described with reference to FIG. 2, the richer the air-fuel ratio becomes, the higher the concentration of NH3 in exhaust gas becomes in the rich air-fuel ratio range. Further, the ammonia sensor 18 outputs a value corresponding to the concentration of NH3 in exhaust gas. Thus, setting the feedback target value according to the map shown in FIG. 6 means setting the target air-fuel ratio to the stoichiometric air-fuel ratio in the low-load low-rotation range and shifting the target air-fuel ratio to the rich side as the load and the rotational speed increase.

In the routine shown in FIG. 5, the processings starting from step 100 are thereafter performed. These processings are identical to those of the first embodiment of the invention. As a result, the air-fuel ratio of the internal combustion engine 10 is controlled such that the output of the ammonia sensor 18 coincides with the feedback target value.

Owing to the performance of the processings described above, in this embodiment of the invention, the air-fuel ratio of exhaust gas in the internal combustion engine 10 is accurately controlled to the value in the neighborhood of the stoichiometric air-fuel ratio in the low-load low-rotation range. In the low-load low-rotation range, the generation amount of NOx is small. Therefore, even when the control target is equal to the stoichiometric air-fuel ratio (the target on the lean side with respect to the case of the first embodiment of the invention), the discharge of a large amount of NOx does not occur as a result of a deviation of the air-fuel ratio. On the other hand, in this range, the activity of the three-way catalyst 14 tends to be low, but the generation amounts of HC and CO are also small. Therefore, the discharge of large amounts of HC and CO can also be prevented. Thus, according to this system, good emission properties can be realized in the low-load low-rotation range.

According to the aforementioned processings, the control target of the air-fuel ratio is shifted to the rich side as the engine rotational speed Ne and the engine load rise. The amount of NOx generated as a result of a deviation of the air-fuel ratio to the lean side increases as the load increases and as the rotational speed increases. When the control target is changed as described above as the load and the rotational speed change, the possibility of the deviation of the air-fuel ratio to the lean side decreases as the load and the rotational speed increase. As a result, the generation of NOx can be made unlikely. Thus, according to this system, the discharge amount of NOx can be sufficiently suppressed in the entire operation range of the internal combustion engine 10.

Further, the three-way catalyst 14 enhances the purification capacity for HC and CO as the operation range of the internal combustion engine 10 transits to the high-load high-rotation range. Thus, even when the generation amounts of HC and CO increase due to increases in the load and the rotational speed, the three-way catalyst 14 can appropriately purify HC and CO. Thus, according to this system, the discharge amounts of HC and CO can also be sufficiently suppressed in the entire operation range of the internal combustion engine.

Figure 7:
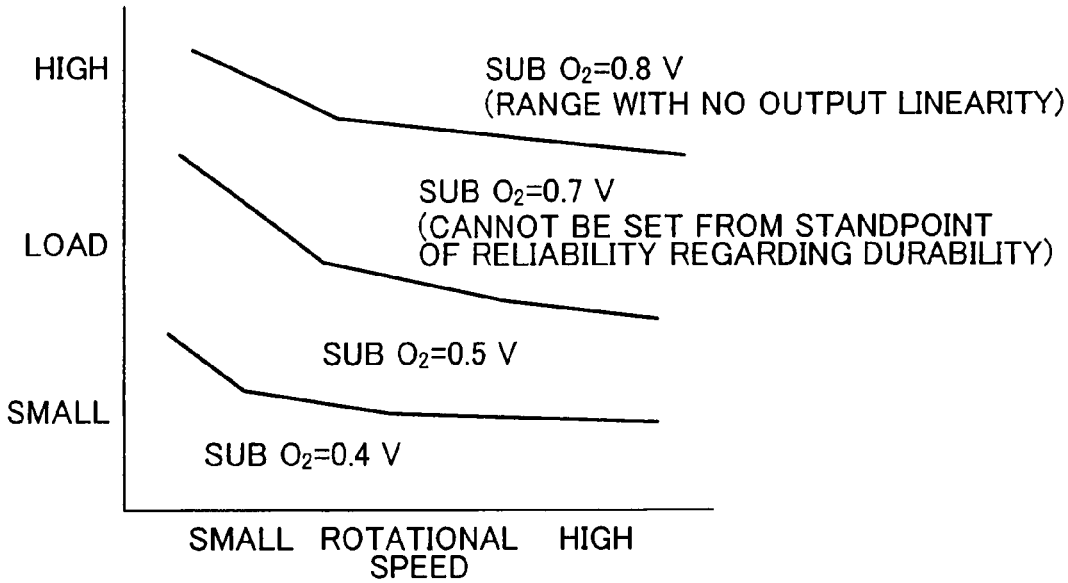
FIG. 7 is a diagram showing a map requested in using an oxygen sensor to achieve an effect achieved by a system according to the second embodiment of the invention.

FIG. 7 is a diagram for explaining a condition for realizing the operation of the foregoing second embodiment of the invention with a system employing an oxygen sensor. In the system equipped with the oxygen sensor downstream of the three-way catalyst 14, with a view to realizing an operation similar to that of the second embodiment of the invention, the output target of the oxygen sensor needs to be changed as shown in FIG. 7 in accordance with the operation state of the internal combustion engine 10.

In the system according to the second embodiment of the invention, an improvement in emission properties is made by shifting the control target of the air-fuel ratio to the rich side as the load and the rotational speed increase. In the system equipped with the oxygen sensor downstream of the catalyst, with a view to shifting the control target to the rich side in a similar manner, the output target of the oxygen sensor needs to be set to a value of 0.7 to 0.8 V in or between the intermediate-load intermediate-rotation range and the high-load high-rotation range, as shown in FIG. 7. However, as described above, the applicable upper-limit of the output target of the oxygen sensor is about 0.6 V. Thus, in the system employing the oxygen sensor, the control target of the air-fuel ratio cannot be changed in the same manner as in the case of the second embodiment of the invention. In this respect, the system according to the second embodiment of the invention can achieve an effect that cannot be achieved by the system employing the oxygen sensor to perform the sub-feedback control.

In the foregoing second embodiment of the invention, "the operation state detection means" may be realized through the performance of the processings of steps 120 and 122 by the ECU 30. Further, "the control parameter setting means" may be realized through the performance of the processings of steps 102 to 110 by the ECU 30. Furthermore, "the target value change means" may be realized through the performance of the processing of step 124 by the ECU 30.

Third Embodiment

[Features of Third Embodiment] Next, the third embodiment of the invention will be described with reference to FIG. 8. A system according to this embodiment of the invention can be realized by causing the ECU 30 to execute a later-described routine shown in FIG. 8 instead of the routine shown in FIG. 4 or FIG. 5 in the system according to the foregoing first embodiment of the invention or the foregoing second embodiment of the invention.

In the foregoing first embodiment of the invention and the foregoing second embodiment of the invention, the output of the ammonia sensor 18 and the target value are compared in magnitude with each other, and the sub-feedback update amount DSFBG is set to −0.01 or 0.01 on the basis of a result of the comparison. That is, in the first embodiment of the invention and the second embodiment of the invention, the sub-feedback learning value SFBG is always increased/reduced with a certain width regardless of the amount of divergence of the output of the ammonia sensor 18 from the target value.

However, in order to swiftly make the air-fuel ratio of exhaust gas in the internal combustion engine 10 coincident with the target air-fuel ratio, the correction width of the sub-feedback learning value SFBG may be increased as the amount of divergence of the output of the ammonia sensor, 18 from the target value increases. Thus, in this embodiment of the invention, the value set as the sub-feedback update amount DSFBG is changed in accordance with the amount of divergence.

Figure 8:
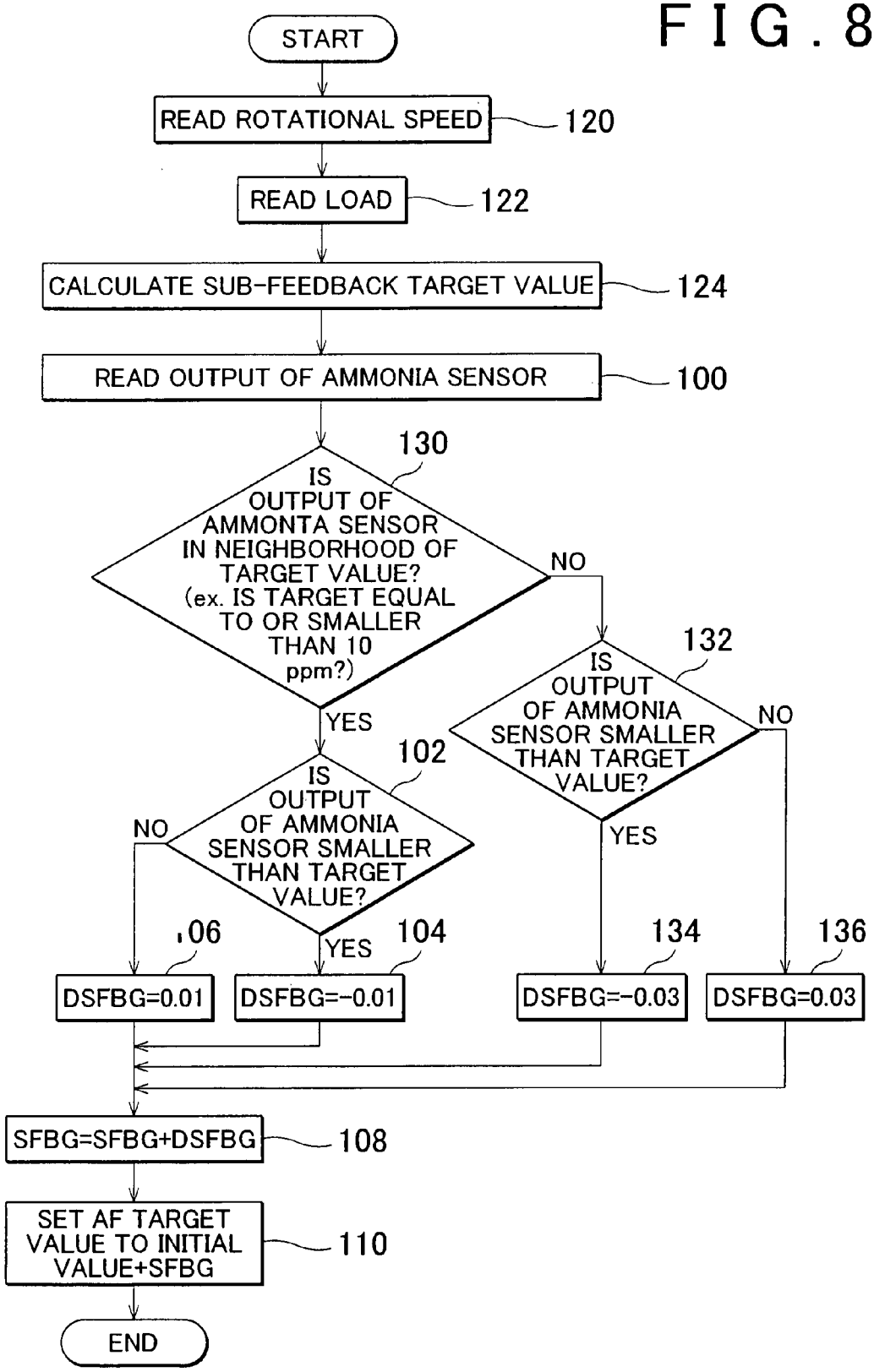
FIG. 8 is a flowchart of a routine executed in the third embodiment of the invention.

[Concrete Processings in Third Embodiment] FIG. 8 is a flowchart of a routine executed by the ECU 30 to realize the sub-feedback control in this embodiment of the invention. The routine shown in FIG. 8 is identical to the routine shown in FIG. 5 except in that steps 130 to 136 are inserted after step 100. Hereinafter, referring to FIG. 8, steps identical to those shown in FIG. 5 will be denoted by the same reference numerals, and the description of these steps will be omitted or simplified.

In the routine shown in FIG. 8, following the processings of steps 120 to 100, it is determined whether or not the output of the ammonia sensor 18 is in the neighborhood of the target value set in step 124 (step 130). More specifically, it is determined whether or not the difference between the concentration of NH3 indicated by the output of the ammonia sensor 18 and the concentration of NH3 indicated by the aforementioned target value is equal to or smaller than 10 ppm.

When the result of the aforementioned determination is positive, namely, when it is determined that the output of the ammonia sensor 18 is located in the neighborhood of the target value, the processings starting from step 102 are thereafter performed. In this case, the sub-feedback update amount DSFBG is set to −0.01 or 0.01 depending on whether or not the output of the ammonia sensor 18 is smaller than the target value. The sub-feedback learning value SFBG is corrected with the width between those set values.

On the other hand, when the result of the determination in the aforementioned step 130 is negative, the processings starting from step 132 are thereafter performed. In this case, the sub-feedback update amount DSFBG is set to −0.03 or 0.03 depending on whether or not the output of the ammonia sensor 18 is smaller than the target value (steps 134 and 136). Then, through the processings starting from step 108, the sub-feedback learning value SFBG is corrected with the width between those set values.

According to the aforementioned processings, when the output of the ammonia sensor 18 is located in the neighborhood of the target value, accurate air-fuel ratio control can be realized by correcting the sub-feedback learning value SFBG with a very small width. Further, when the output of the ammonia sensor 18 greatly diverges from the target value, the air-fuel ratio of exhaust gas can be swiftly made close to the target air-fuel ratio by correcting the sub-feedback learning value SFBG with a large width. Thus, according to the system of this embodiment of the invention, the control accuracy of the air-fuel ratio of exhaust gas can further be enhanced.

Fourth Embodiment

Figure 9:
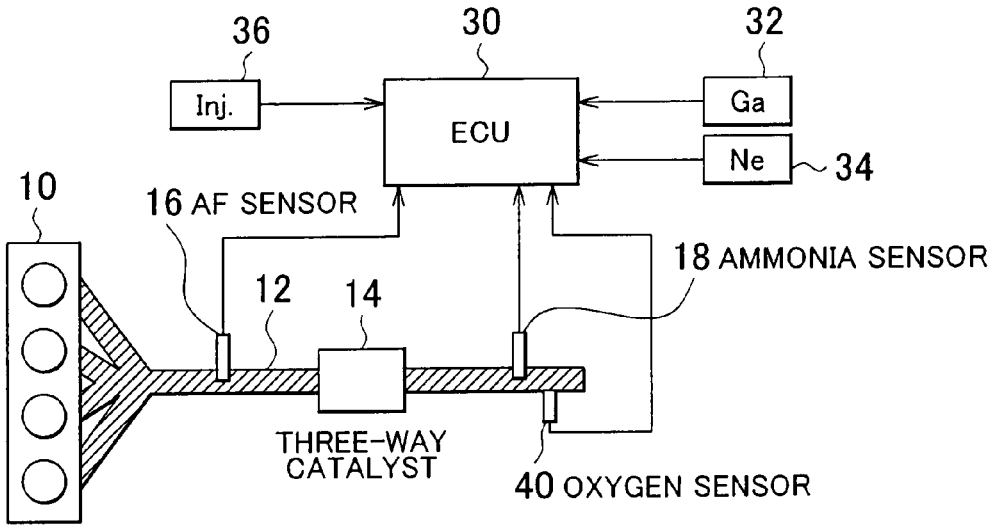
FIG. 9 is a diagram for explaining the configuration of the fourth embodiment of the invention.

[Configuration of Fourth Embodiment] Next, the fourth embodiment of the invention will be described with reference to FIGS. 9 to 13. FIG. 9 is a diagram for explaining the configuration of a system according to this embodiment of the invention. The system shown in FIG. 9 is identical in configuration to the system shown in FIG. 1 except in that an oxygen sensor 40 is provided. Hereinafter, referring to FIG. 9, component elements identical to those shown in FIG. 1 will be denoted by the common reference numerals, and the description of these component elements will be omitted or simplified.

As shown in FIG. 9, the system according to this embodiment of the invention is equipped with the oxygen sensor 40 downstream of the three-way catalyst 14. As is the case with the output of the ammonia sensor 18 and the like, an output of the oxygen sensor 40 is supplied to the ECU 30. The ECU 30 can determine, on the basis of the output of the oxygen sensor 40, whether the air-fuel ratio downstream of the three-way catalyst 14 is rich or lean.

Figure 10:
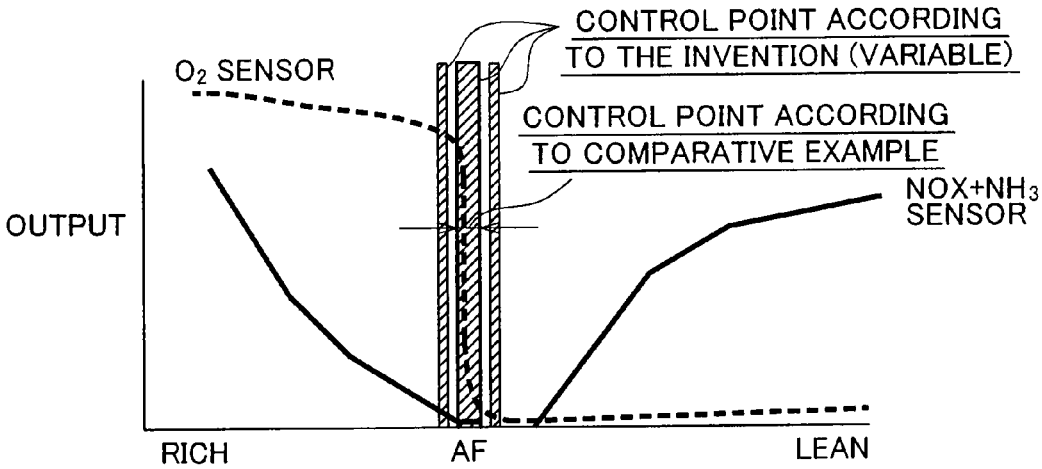
FIG. 10 is a diagram for explaining a range where a system according to the fourth embodiment of the invention can control the air-fuel ratio of exhaust gas.

[Features of Fourth Embodiment] FIG. 10 is a diagram for explaining a range where the air-fuel ratio of exhaust gas can be controlled by the system according to this embodiment of the invention. In the case where the sub-feedback control is performed on the basis of the output of the oxygen sensor 40, the control point of the air-fuel ratio is usually limited to a range indicated as "CONTROL POINT ACCORDING TO COMPARATIVE EXAMPLE" in FIG. 10, namely, to the neighborhood of the inversion air-fuel ratio of the oxygen sensor 40.

In the system according to this embodiment of the invention, the control point of the air-fuel ratio can be set to a range richer than the aforementioned "CONTROL POINT ACCORDING TO COMPARATIVE EXAMPLE" by performing the sub-feedback control on the basis of the output of the ammonia sensor 18. Further, when the criterial value to be compared with the output of the oxygen sensor 40 is set to a sufficiently small value, the control point based on the output of the oxygen sensor 40 can also be shifted to a range leaner than the "CONTROL POINT ACCORDING TO COMPARATIVE EXAMPLE". Thus, according to the system of this embodiment of the invention, the control point can be set within a sufficiently wider range than a control point generally realized by a system having only an oxygen sensor disposed downstream of a catalyst (see a range indicated as "CONTROL POINT ACCORDING TO THIS EMBODIMENT OF THE INVENTION (VARIABLE)" in FIG. 10).

The wider the settable range of the control point of the air-fuel ratio becomes, the higher the degree of freedom regarding the air-fuel ratio control of the internal combustion engine 10 becomes. Accordingly, the system according to this embodiment of the invention makes it possible to perform the sub-feedback control of the air-fuel ratio with a higher degree of freedom than the system equipped with only the oxygen sensor downstream of the catalyst.

Figures 11, 12:
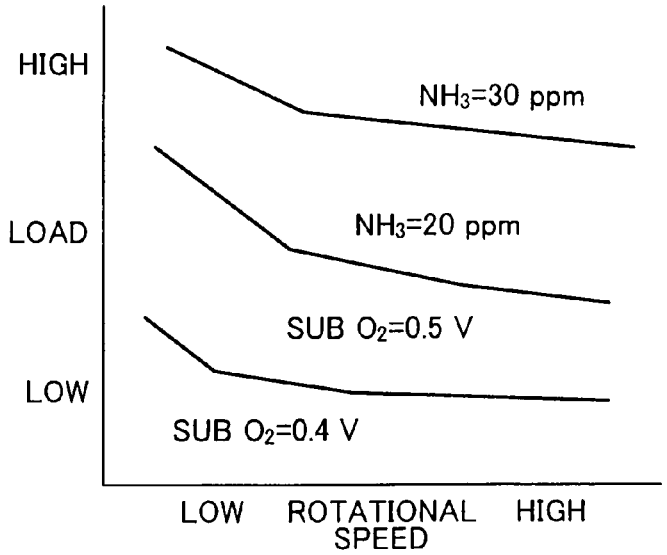
FIG. 11 is a diagram of a comparison between advantages and disadvantages of an oxygen sensor and an ammonia sensor.
FIG. 12 is a map that determines a relationship between the outline of sub-feedback control performed in the fourth embodiment of the invention and an operation range of an internal combustion engine.

FIG. 11 is a diagram of a comparison between advantages and disadvantages of the oxygen sensor 40 and the ammonia sensor 18. As shown in FIG. 11, the oxygen sensor is advantageous in high absolute accuracy and good responsiveness. On the other hand, the oxygen sensor is disadvantageous in the lack of linearity in output and a reduction in output resulting from aged deterioration. Meanwhile, the ammonia sensor 18 is advantageous in the presence of linearity in output and disadvantageous in the absence of absolute accuracy, bad responsiveness, and the inability to distinguish between NH3 and NOx.

As described in the foregoing second embodiment of the invention, in the low-load low-rotation range, it is desirable to set the AF target value of the sub-feedback control on the lean side in consideration of a decrease in the purification capacity for HC 10, and CO. On the other hand, in the high-load high-rotation range, the AF target value may be shifted to the rich side, giving priority to the suppression of the discharge of NOx.

In the system according to this embodiment of the invention, the output of the oxygen sensor 40 and the output of the ammonia sensor 18 can be utilized as base data of the sub-feedback control. The oxygen sensor 40 inverts one of a rich output and a lean output to the other in the neighborhood of the stoichiometric air-fuel ratio, and the output of the oxygen sensor 40 converges to the lean output in a range slightly leaner than the stoichiometric air-fuel ratio. Thus, when the sub-feedback control is performed on the basis of the output of the oxygen sensor 40, the AF target value can be set on the lean side. On the other hand, the ammonia sensor 18 is sensitive to the air-fuel ratio in the rich range. Thus, when the sub-feedback control is performed on the basis of the output of the ammonia sensor 18, the AF target value can be set on the rich side.

FIG. 12 is a map that determines a relationship between the outline of the sub-feedback control performed in this embodiment of the invention and the operation range of the internal combustion engine 10. As indicated by this map, in this embodiment of the invention, the sub-feedback control is performed on the basis of the output of the oxygen sensor 40 in the low-load low-rotation range, with the criterial value set to 0.4 V. In this case, the sub-feedback control can be performed with the AF target value sufficiently set on the lean side.

Further, in the first intermediate-load intermediate-rotation range, the sub-feedback control is performed on the basis of the output of the oxygen sensor 40, with the criterial value set to 0.5 V. Since the criterial value is set to 0.5 V, the AF target value is slightly returned to the rich side in this range in comparison with the AF target value in the low-load low-rotation range.

In the range where the load or the rotational speed is slightly higher than in the first intermediate-load intermediate-rotation range, namely, in the second intermediate-load intermediate-rotation range, the sub-feedback control is performed on the basis of the output of the ammonia sensor 18, with the criterial value of NH3 set to 20 ppm. NH3 is generated in the rich range. Thus, in this range, the sub-feedback control can be performed with the AF target value set slightly on the rich side with respect to the stoichiometric air-fuel ratio.

In the high-load high-rotation range, the sub-feedback control is performed on the basis of the output of the ammonia sensor 18 with the criterial value for NH3 set to 30 ppm. Since the criterial value has been increased to 30 ppm, the sub-feedback control can be performed in this range using the AF target value that is still richer than the AF target value set in the second intermediate-load intermediate-rotation range.

As described above, the system according to this embodiment of the invention changes over the sensor output and criterial value that are utilized to perform the sub-feedback control, in accordance with the operation state of the internal combustion engine 10. According to this method, the AF target value can be changed over a wider range. Thus, according to the system of this embodiment of the invention, the degree of freedom in the air-fuel ratio control can further be enhanced.

Further, as described with reference to FIG. 11, the oxygen sensor 40 used to set the AF target value on the lean side is more excellent in responsiveness than the ammonia sensor 18. In the case where the AF target value is set on the lean side using the oxygen sensor 40 (further to the lean side in comparison with the case of the second embodiment of the invention), when the sensor has bad responsiveness, the air-fuel ratio is likely to become excessively lean. In the low-load low-rotation range, the discharge amount of NOx is small. However, in order to obtain good emission properties, it is desirable to prevent the air-fuel ratio from deviating excessively to the lean side even in such a range. According to the shift of the AF target value to the lean side with the aid of the oxygen sensor 40, the air-fuel ratio can be prevented from deviating excessively to the lean side while shifting the AF target value to the lean side, owing to good responsiveness of the sensor. Thus, according to the system of this embodiment of the invention, NOx can be prevented from being unduly discharged in the low-load low-rotation range.

Further, as described with reference to FIG. 11, the ammonia sensor 18 lacks absolute accuracy, but outputs a linear value for the concentration of NH3. Thus, when the sub-feedback control is performed on the basis of the output of the ammonia sensor 18, the AF target value can be shifted sufficiently to the rich side. In this case, owing to bad responsiveness of the sensor, the air-fuel ratio is likely to deviate relatively greatly. However, the system according to this embodiment of the invention performs the sub-feedback control with the aid of the ammonia sensor 18 only in the range on the high-load high-rotation side where the three-way catalyst 14 is sufficiently activated. In this case, even when the generation amounts of HC and CO increase as a result of deviation of the air-fuel ratio to the rich side, the three-way catalyst 14 can sufficiently purify HC and CO. On the other hand, the AF target value has greatly been shifted to the rich side. Therefore, the air-fuel ratio is unlikely to deviate to the extent of generating an excessive amount of NOx.

Due to the reason described above, the system according to this embodiment of the invention can ensure a higher degree of freedom as to air-fuel ratio control. Further, according to this system, more excellent emission properties can be realized in the entire operation range of the internal combustion engine 10.

Figure 13:
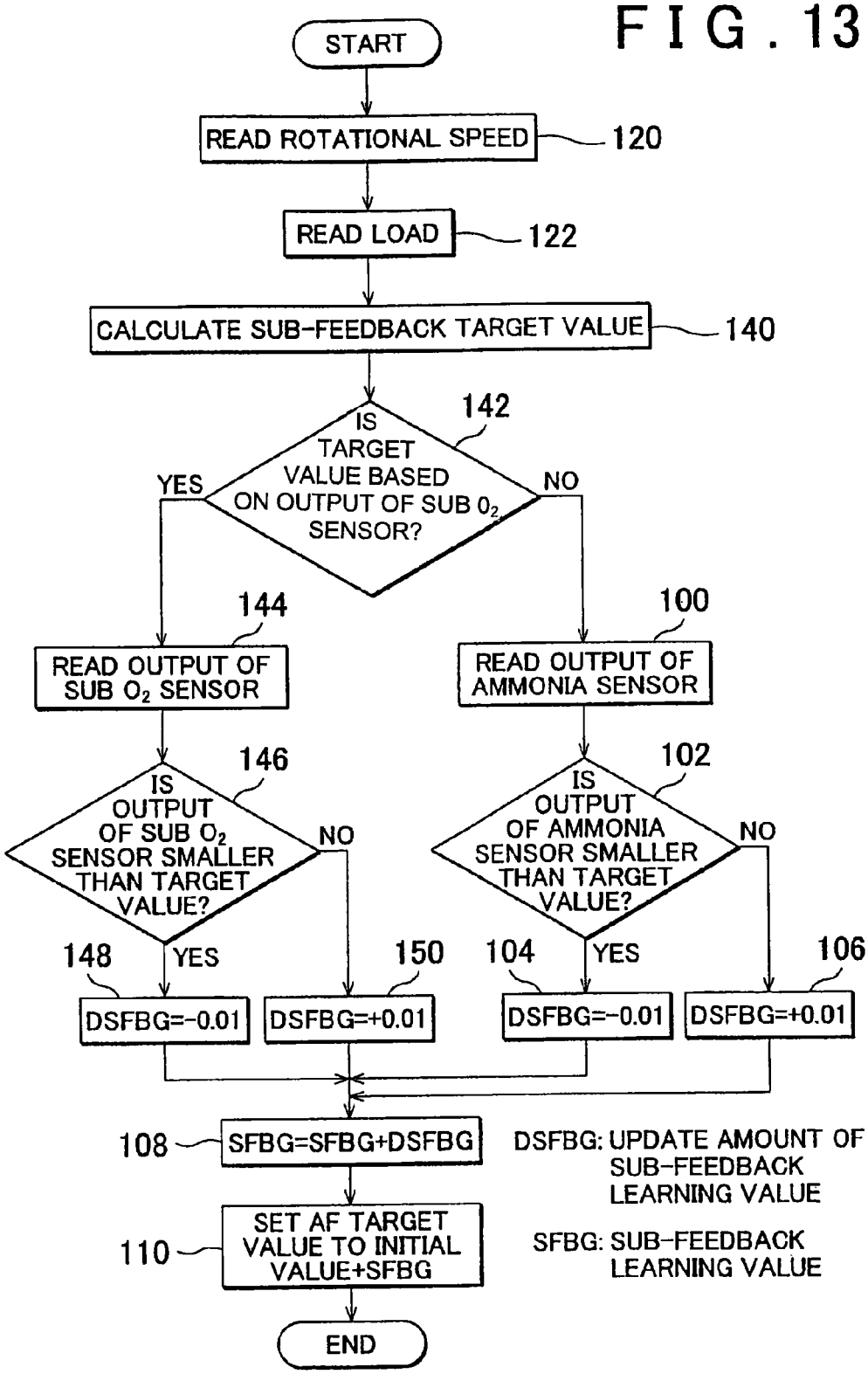
FIG. 13 is a flowchart of a routine executed in the fourth embodiment of the invention.

[Concrete Processings in Fourth Embodiment] FIG. 13 is a flowchart of a routine executed by the ECU 30 in this embodiment of the invention to realize the aforementioned function. The routine shown in FIG. 13 is identical to the routine shown in FIG. 5 except in that step 124 is replaced by step 140 and that steps 142 to 150 are inserted after step 140. Hereinafter, steps shown in FIG. 13 which are common to those shown in FIG. 5 will be denoted by the same reference numerals, and the description of these steps will be omitted or simplified.

In the routine shown in FIG. 13, following the processings of steps 120 and 122, the sensor output to be utilized for the sub-feedback control is selected, and the sub-feedback target value is determined, on the basis of the engine rotational speed Ne and the engine load (step 140). The ECU 30 has stored therein a map shown in FIG. 12, and performs the aforementioned processings according to this map. For example, when the engine rotational speed Ne and the engine load belong to the low-load low-rotation range, the output of the oxygen sensor 40 is selected as the output to be utilized for the sub-feedback control, and the sub-feedback target value is set to 0.4 V.

It is then determined whether the selected output is the output of the oxygen sensor 40 or the output of the ammonia sensor 18 (step 142). As a result, when it is determined that the output of the ammonia sensor 18 is selected (when the result of the determination is No), the AF target value is thereafter subjected to feedback control through the performance of the processings of steps 100 to 110.

On the other hand, when it is determined in step 142 that the selected output is the output of the oxygen sensor 40, the processings for proceeding with the sub-feedback control based on that output are thereafter performed. More specifically, the output of the oxygen sensor 40 is first read (step 144). It is then determined whether or not the output of the oxygen sensor 40 is smaller than the target value set in the aforementioned step 140 (step 146).

As a result, when it is determined that the output of the oxygen sensor 40 is smaller than the target value, it can be determined that the air-fuel ratio downstream of the three-way catalyst 14 is deviant from the target air-fuel ratio to the lean side. In this case, the sub-feedback update amount DSFBG is set to −0.01 (step 148).

On the other hand, when it is determined that the output of the oxygen sensor 40 is not smaller than the target value, it can be determined that the air-fuel ratio of exhaust gas downstream of the three-way catalyst 14 is deviant from the target air-fuel ratio to the rich side. In this case, the sub-feedback update amount DSFBG is set to 0.01 (step 150).

After that, a corrective processing for the AF target value based on the sub-feedback update amount DSFBG is performed through the processings of steps 108 and 110. As a result, when the air-fuel ratio of exhaust gas downstream of the catalyst is deviant to the lean side, the AF target value is corrected to the rich side, and as a result, the air-fuel ratio of exhaust gas is made close to the target thereof. On the other hand, when the air-fuel ratio of exhaust gas is deviant to the rich side, the AF target value is corrected to the lean side, and the air-fuel ratio of exhaust gas is made close to the target thereof.

According to the processing described above, the sensor and the target value as the base of the sub-feedback control can be changed over as shown in FIG. 12 in accordance with the operation state of the internal combustion engine 10. Thus, according to the system of this embodiment of the invention, the air-fuel ratio of exhaust gas can be controlled to a value desirable in terms of the suppression of the discharge amounts of HC, CO, and NOx, in accordance with the operation state of the internal combustion engine 10. As a result, excellent emission properties can be realized in the entire operation range.

In the foregoing fourth embodiment of the invention, the sub-feedback control is performed on the basis of only the output of the oxygen sensor 40 in the range on the low-load low-rotation side. However, the invention is not limited to this configuration. That is, the sub-feedback control may be performed on the basis of both the output of the oxygen sensor 40 and the output of the ammonia sensor 18 in the range on the low-load low-rotation side.

In the foregoing fourth embodiment of the invention, "the third feedback means" is realized through the performance of the processings of steps 144 to 150 and steps 108 and 110 by the ECU 30. Further, "the second feedback selection means" is realized through the performance of the processing of step 140 by the ECU 30. Furthermore, in this case, "the operation state detection means" is realized through the performance of the processings of steps 120 and 122 by the ECU 30.

Fifth Embodiment

[Features of Fifth Embodiment] Next, the fifth embodiment of the invention will be described with reference to FIGS. 14 to 16. A system according to this embodiment of the invention is realized by causing the ECU 30 to execute a later-described routine shown in FIG. 15 in the system shown in FIG. 9.

As is the case with the system according to the fourth embodiment of the invention, the system according to this embodiment of the invention is equipped with the oxygen sensor 40 as well as the ammonia sensor 18 downstream of the three-way catalyst 14. FIG. 14 is a diagram for explaining how the system according to this embodiment of the invention selectively uses those two sensors.

Figure 14:
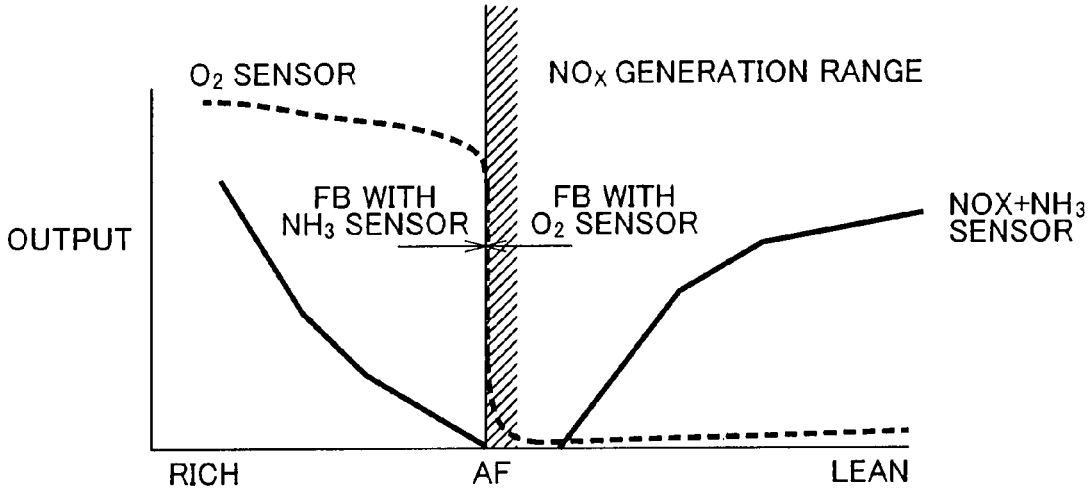
FIG. 14 is a diagram for explaining how a system according to the fifth embodiment of the invention selectively uses an oxygen sensor and an ammonia sensor.

In the system according to this embodiment of the invention, as shown in FIG. 14, the sub-feedback control is performed on the basis of the output of the oxygen sensor 40 in a range where the oxygen sensor 40 outputs a value on the lean side (the lean range). As described with reference to FIG. 11, the oxygen sensor 40 has excellent responsiveness. Thus, in the system according to this embodiment of the invention, when the air-fuel ratio of exhaust gas is lean and the oxygen sensor 40 outputs a value on the lean side, the air-fuel ratio is swiftly corrected toward the stoichiometric air-fuel ratio with excellent responsiveness.

In the lean range, NOx are likely to be generated. Further, as described with reference to FIG. 3, the three-way catalyst 14 abruptly decreases in the purification rate for NOx as the air-fuel ratio of exhaust gas is shifted to the lean side. If the deviation of the air-fuel ratio to the lean side is swiftly canceled, the generation of NOx is suppressed, and a decrease in the NOx purification rate of the three-way catalyst 14 can also be avoided. Thus, according to the system of this embodiment of the invention, the discharge amount of NOx can be sufficiently suppressed.

In the system according to this embodiment of the invention, as shown in FIG. 14, the sub-feedback control is performed on the basis of the output of the ammonia sensor 18 in a range where the oxygen sensor 40 outputs a value on the rich side (the rich range). The ammonia sensor 18 is sensitive to a rich air-fuel ratio. Thus, in the sub-feedback control based on the output of the ammonia sensor 18, the AF target value can be set to a value shifted from the stoichiometric air-fuel ratio to the rich side.

According to this setting, it is possible to reduce the frequency with which the air-fuel ratio enters the lean range, and create a situation where NOx are unlikely to be produced. Further, the output of the ammonia sensor 18 has linearity for the air-fuel ratio. Therefore, according to the control based on the output of the ammonia sensor 18, the deviation amount of the air-fuel ratio can be fed back with accuracy. Thus, according to the system of this embodiment of the invention, the air-fuel ratio can be accurately controlled while suppressing the production of NOx in the rich range.

Due to the reason described above, according to the system of this embodiment of the invention, when the air-fuel ratio of exhaust gas enters the lean range, the deviation of the air-fuel ratio to the lean side can be swiftly canceled. Further, while the air-fuel ratio of exhaust gas belongs to the rich range, it is possible to perform control with accuracy such that the air-fuel ratio of exhaust gas becomes equal to the AF target value shifted from the stoichiometric air-fuel ratio to the rich side. Thus, according to the system of this embodiment of the invention, the emission properties of the internal combustion engine 10 can be comprehensively improved.

Figure 15:
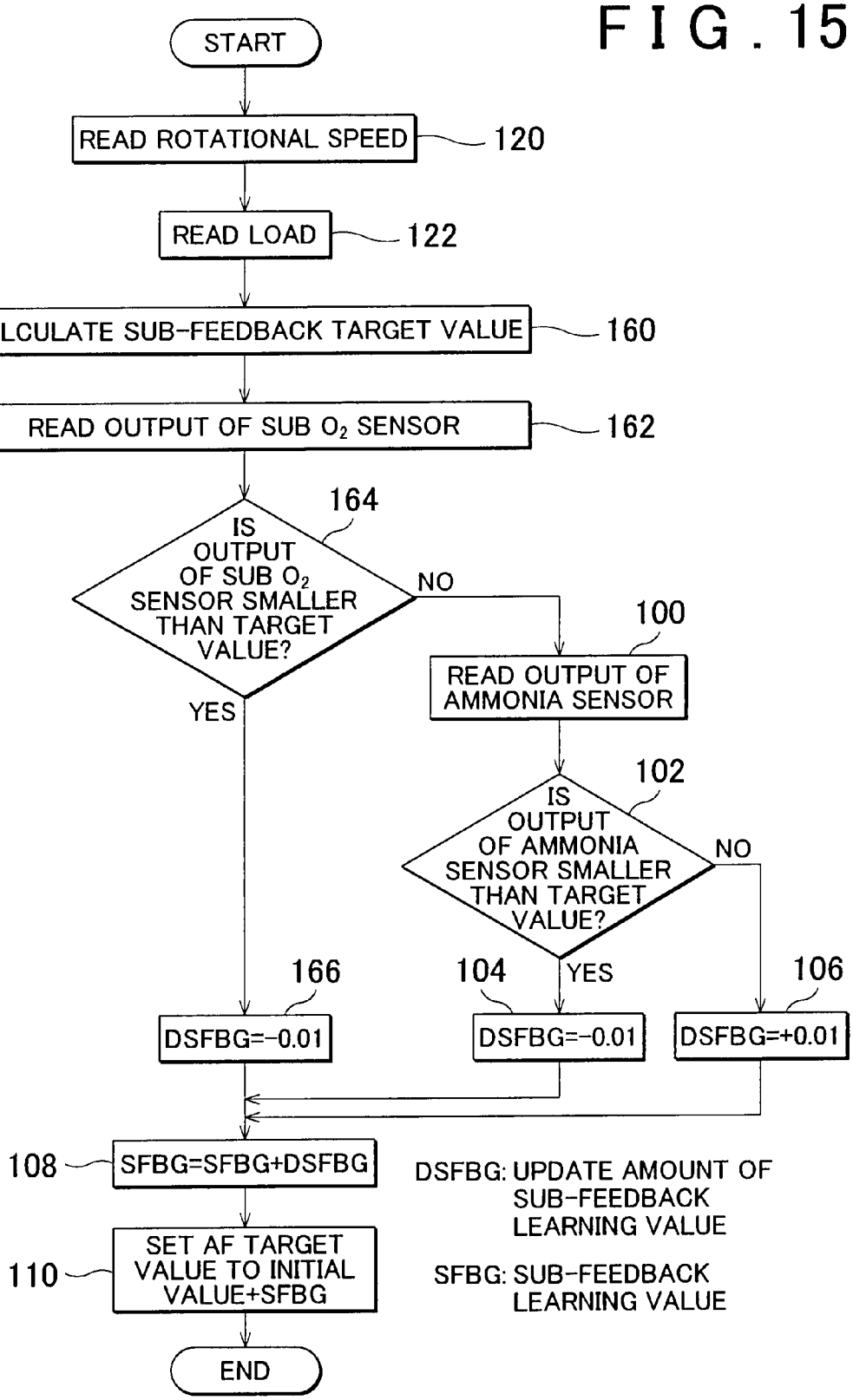
FIG. 15 is a flowchart of a routine executed in the fifth embodiment of the invention.

[Concrete Processings in Fifth Embodiment] FIG. 15 is a flowchart of a routine executed by the ECU 30 to realize the aforementioned function. The routine shown in FIG. 15 is identical to the routine shown in FIG. 5 except in that step 124 is replaced by step 160 and that steps 162 to 166 are inserted after step 160. Hereinafter, steps shown in FIG. 15 which are common to those shown in FIG. 5 will be denoted by the same reference numerals, and the description of these steps will be omitted or simplified.

In the routine shown in FIG. 15, sub-feedback target values are calculated following the processings of steps 120 and 122 (step 160). In this case, more specifically, the sub-feedback target value for the output of the oxygen sensor 40 and the sub-feedback target value for the output of the ammonia sensor 18 are calculated.

Figure 16A:
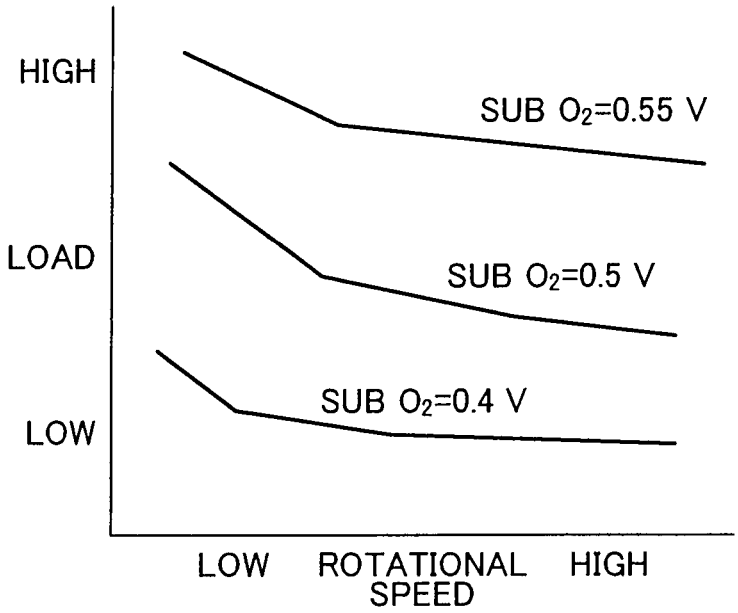
FIGS. 16A and 16B are maps referred to respectively to set a sub-feedback target value for an output of an oxygen sensor and a sub-feedback target value for an output of an ammonia sensor.
Figure 16B:
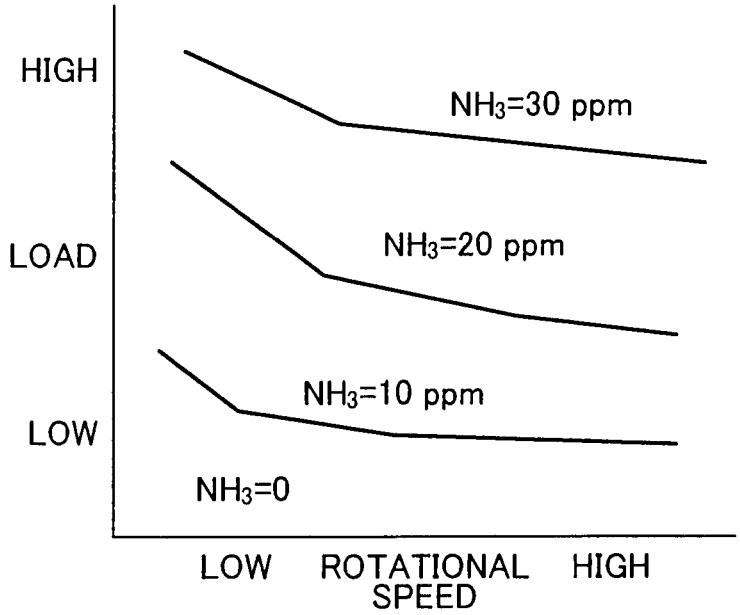

FIG. 16A is a map that determines the sub-feedback target value for the output of the oxygen sensor 40. Further, FIG. 16B is a map that determines the sub-feedback target value for the output of the ammonia sensor 18. The map shown in FIG. 16B is identical to the map used in the second embodiment of the invention (see FIG. 6). The ECU 30 has these maps stored therein. In the aforementioned step 160, the ECU 30 calculates the respective target values by referring to those maps.

In the routine shown in FIG. 15, an output of the oxygen sensor 40 is then read (step 162). It is then determined whether or not the output is smaller than the sub-feedback target value for the output of the oxygen sensor 40 (step 164).

The output of the oxygen sensor 40 abruptly changes across the stoichiometric air-fuel ratio, and decreases as the air-fuel ratio of exhaust gas is shifted to the lean side in the range where the output of the oxygen sensor 40 abruptly changes. Thus, an air-fuel ratio by which it is determined whether or not the condition of the aforementioned step 164 is fulfilled (hereinafter referred to as "a rich-lean threshold") is shifted to the lean side as the sub-feedback target value decreases, and is shifted to the rich side as the target value increases. The maps shown in FIG. 16 are set such that the sub-feedback target value sequentially increases from 0.4 V to 0.5 V as the rotational speed and the load increase. Thus, the aforementioned rich-lean threshold assumes a value shifted furthest to the lean side during operation in the low-load low-rotation range, and changes to the rich side as the engine load and the engine rotational speed increase.

When the fulfillment of the condition of the aforementioned step 164 is recognized, it can be determined that the air-fuel ratio of exhaust gas is located on the lean side with respect to the rich-lean threshold. In this case, the ECU 30 sets the sub-feedback update value DSFBG to −0.01 (step 166). As a result, the AF target value thereafter shifts to the rich side through the performance of the processings of steps 108 and 100.

The oxygen sensor 40 has excellent responsiveness for the ammonia sensor. Thus, the aforementioned shift of the AF target value to the rich side is swiftly carried out after the air-fuel ratio of exhaust gas exceeds the rich-lean threshold. As a result, the deviation of the air-fuel ratio of exhaust gas to the lean side is swiftly canceled, and the discharge of NOx is suppressed.

Further, the rich-lean threshold shifts to the rich side as the engine rotational speed and the engine load rise as described above. Therefore, the air-fuel ratio of exhaust gas realized as a result of the aforementioned processings also shifts to the rich side as the engine rotational speed and the engine load rise. As described in the second embodiment of the invention, when the control center of the air-fuel ratio is shifted to the rich side as the engine load and the engine rotational speed rise, the emission properties of the internal combustion engine 10 can be comprehensively improved. Thus, according to the system of this embodiment of the invention, the effect thereof also makes it possible to improve the emission properties of the internal combustion engine 10.

When the air-fuel ratio of exhaust gas belongs to the lean range, namely, the range on the lean side with respect to the rich-lean threshold, it is determined in the aforementioned step 164 that the output of the oxygen sensor 40 is not smaller than the sub-feedback target value for the output. In this case, the AF target value is thereafter corrected such that the output of the ammonia sensor 18 coincides with the sub-feedback target value for the output, through the processings of steps 100 to 110. As a result, excellent emission properties are realized (see FIGS. 5 and 6) according to a principle similar to that of the second embodiment of the invention.

As described above, according to the routine shown in FIG. 15, when the air-fuel ratio of exhaust gas belongs to the lean range, excellent emission properties can be realized according to the principle similar to that of the second embodiment of the invention. Further, according to this routine, when the air-fuel ratio of exhaust gas enters the lean range, it is possible to swiftly cancel the deviation of the air-fuel ratio of exhaust gas to the lean side and suppress the discharge of NOx through the sub-feedback control based on the output of the oxygen sensor 40. Thus, according to the system of this embodiment of the invention, more excellent emission properties can be realized.

In the foregoing fifth embodiment of the invention, "the direction determination means" may be realized through the performance of the processing of step 164 by the ECU 30. Further, "the second feedback selection means" may be realized through the selective performance of either the processing of step 166 or the processings of steps 100 to 106 by the ECU 30 in accordance with the result of the determination in step 164.

Further, in the foregoing fifth embodiment of the invention, "the second feedback means" may be realized through the performance of the processings of steps 100 to 106 by the ECU 30. Furthermore, "the third feedback means" may be realized through the performance of the processings of steps 164 and 166 by the ECU 30.

Sixth Embodiment

[Features of Sixth Embodiment] Next, the sixth embodiment of the invention will be described with reference to FIG. 17. A system according to this embodiment of the invention can be realized by causing the ECU 30 to execute a later-described routine shown in FIG. 17 in the system shown in FIG. 9.

The system according to the foregoing fifth embodiment of the invention performs feedback control for making the output of the oxygen sensor 40 close to the target value thereof with a certain gain when the air-fuel ratio of exhaust gas belongs to the lean range. Further, the system according to the fifth embodiment of the invention performs feedback control for making the output of the ammonia sensor 18 close to the target value thereof with a certain gain when the air-fuel ratio of exhaust gas belongs to the rich range. The system according to this embodiment of the invention is characterized in that this feedback method is combined with the processing of reflecting the amount of divergence of the sensor output from the target value on the gain.

Figure 17:
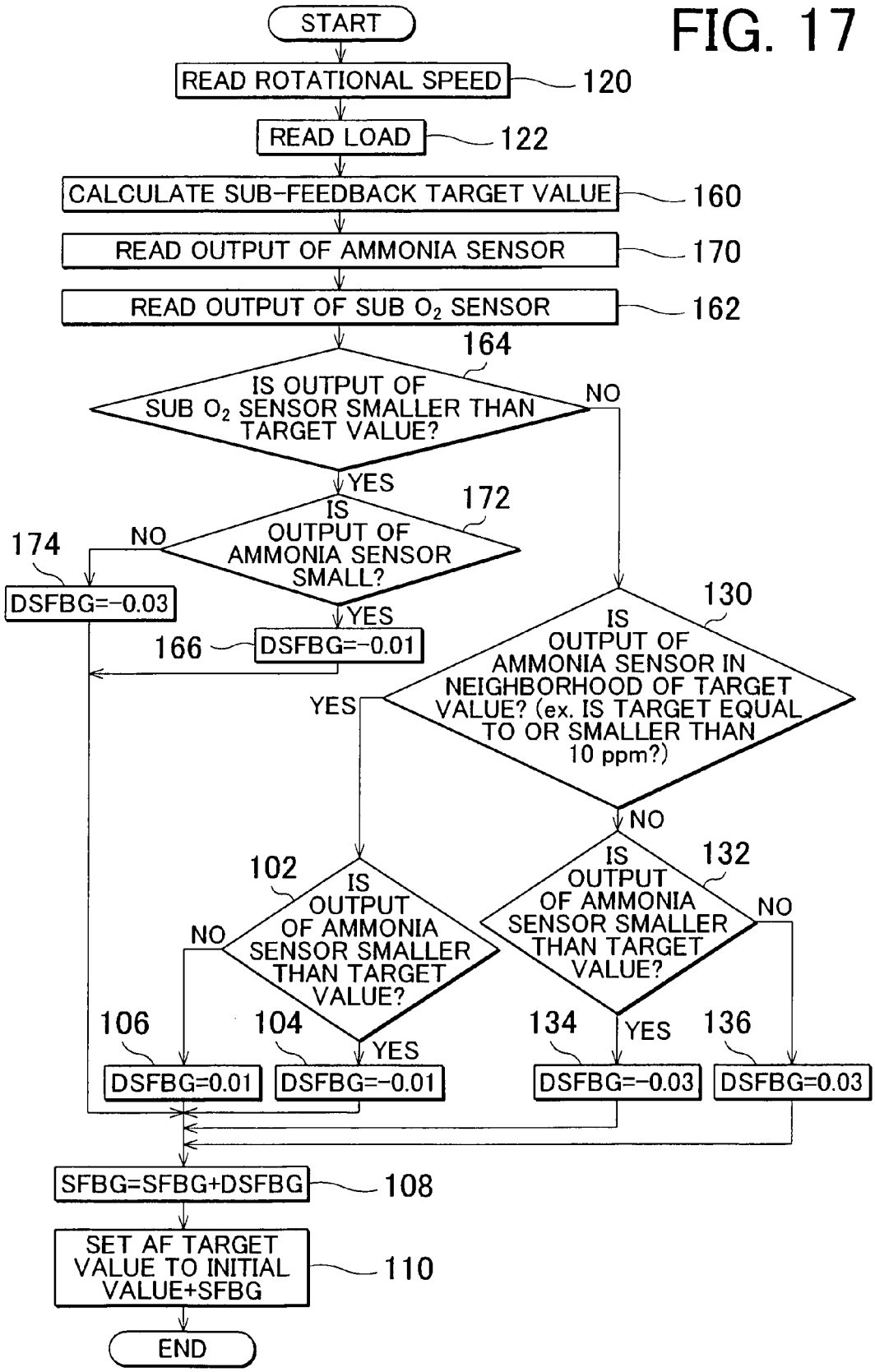
FIG. 17 is a flowchart of a routine executed in the sixth embodiment of the invention.

[Concrete Processings in Sixth Embodiment] FIG. 17 is a flowchart of a routine executed by the ECU 30 in this embodiment of the invention. The routine shown in FIG. 17 is identical to the routine executed in the fifth embodiment of the invention (see FIG. 15) except in the following three differences. The first difference is that step 170 is inserted between steps 160 and 162. The second difference is that steps 172 and 174 are inserted along a route in the case where it is determined in step 164 that the condition is fulfilled. The third difference is that steps 130 to 136 are inserted along a route in the case where it is determined in step 164 that the condition is not fulfilled.

In steps 130 to 136, which constitute the aforementioned third difference, are identical to the processings included in the routine executed in the third embodiment of the invention (see FIG. 8). Hereinafter, steps shown in FIG. 17 which are identical to those shown in FIG. 15 or FIG. 8 will be denoted by the common reference numerals, and the description of these steps will be omitted or simplified.

In the routine shown in FIG. 17, sub-feedback target values are calculated in step 160 according to a method similar to that of the fifth embodiment of the invention. In this case, more specifically, both a sub-feedback target value for an output of the oxygen sensor 40 and a sub-feedback target value for an output of the ammonia sensor 18 are calculated according to the maps shown in FIGS. 16A and 16B respectively.

The output of the ammonia sensor 18 and the output of the oxygen sensor 40 are then sequentially read (steps 170 and 162). It is then determined in step 164 whether or not the output of the oxygen sensor 40 is smaller than the target value for the output.

The condition of step 164 is fulfilled when the air-fuel ratio of exhaust gas belongs to the lean range. Accordingly, when the fulfillment of this condition is denied, it can be determined that the air-fuel ratio of exhaust gas belongs to the rich range. In this case, the sub-feedback update amount DSFBG for making the output of the ammonia sensor 18 close to the target value thereof is thereafter calculated through the processings starting from step 130.

Especially, when it is determined in step 130 that the output of the ammonia sensor 18 is not in the neighborhood of the target value, the sub-feedback update amount DSFBG is calculated in the routine shown in FIG. 17 with a gain three times as large as a gain used in the case where it is determined that the output is in the neighborhood of the target value (see steps 134 and 136).

When it is determined in step 164 that the output of the oxygen sensor 40 is smaller than the target value, it can be determined that the air-fuel ratio of exhaust gas belongs to the lean range. In the routine shown in FIG. 17, in this case, it is first determined whether or not the output of the ammonia sensor 18 is smaller than a criterial value (10 ppm in this embodiment of the invention) (step 172).

As described with reference to FIG. 2, the ammonia sensor 18 is sensitive to NH3 and to NOx as well. Then, under a situation where the air-fuel ratio of exhaust gas is greatly shifted to the lean side, the ammonia sensor 18 raises the output thereof in reaction to the NOx in exhaust gas. Thus, when the ammonia sensor 18 outputs a large value in the lean range, it can be determined that the air-fuel ratio of exhaust gas is drastically deviant to the lean side.

When it is determined in step 172 that the output of the ammonia sensor 18 is smaller than the criterial value, the ECU 30 determines that the air-fuel ratio of exhaust gas is not greatly deviant to the lean side. In this case, with a view to correcting the air-fuel ratio slightly to the rich side, the sub-feedback update amount DSFBG is thereafter set to −0.01 in step 166. On the other hand, when it is determined in step 172 that the output of the ammonia sensor 18 is larger than the criterial value, the ECU 30 determines that the air-fuel ratio is greatly deviant to the lean side. In this case, with a view to correcting the air-fuel ratio of exhaust gas greatly to the rich side, the sub-feedback update amount DSFBG is set to −0.03.

As described above, according to the routine shown in FIG. 17, the output of the oxygen sensor 40 and the output of the ammonia sensor 18 can be selectively adopted as the base of the sub-feedback control depending on whether the air-fuel ratio of exhaust gas belongs to the rich range or the lean range. Further, according to this routine, when the outputs of those sensors are greatly different from the target values respectively, it is possible to set a gain three times as large as a gain used in the case where those outputs are in the neighborhood of the target values respectively. Thus, according to the system of this embodiment of the invention, an effect similar to that of the system according to the fifth embodiment of the invention can be achieved, and the deviation of the air-fuel ratio of exhaust gas can be canceled with more excellent responsiveness.

In the foregoing sixth embodiment of the invention, "the third feedback means", namely, "the control parameter setting means" and "the gain setting means" may be realized through the performance of the processings of steps 172, 166, and 174 by the ECU 30.

While the invention has been described with reference to what are considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single element, are also within the scope of the invention.

The invention claimed is:

1. An air-fuel ratio control apparatus for an internal combustion engine, comprising:

an air-fuel ratio adjustment mechanism that adjusts an air-fuel ratio of the internal combustion engine;

an exhaust gas air-fuel ratio detection unit that detects an air-fuel ratio of an exhaust gas;

an ammonia sensor disposed in an exhaust system of the internal combustion engine;

a catalyst disposed in the exhaust system to be located upstream of the ammonia sensor;

an oxygen sensor disposed downstream of the catalyst;

a first feedback portion that subjects the air-fuel ratio adjustment mechanism to a first feedback control such that the air-fuel ratio of exhaust gas becomes close to a target air-fuel ratio in a neighborhood of a stoichiometric air-fuel ratio, wherein the exhaust gas air-fuel ratio detection unit includes an air-fuel ratio sensor disposed upstream of the catalyst, and the first feedback portion performs the first feedback control on a basis of an output of the air-fuel ratio sensor;

a second feedback portion that subjects the air-fuel ratio adjustment mechanism to a second feedback control based on an output value of the ammonia sensor;

a third feedback portion that subjects the air-fuel ratio adjustment mechanism to the second feedback control based on an output value of the oxygen sensor or the output values of the ammonia sensor and the oxygen sensor, and a second feedback selection portion that selectively actuates the second feedback portion and the third feedback portion.

2. The air-fuel ratio control apparatus according to claim 1, wherein the second feedback portion determines that an output of the ammonia sensor is for ammonia, when the output of the ammonia sensor is larger than an ammonia target value.

3. The air-fuel ratio control apparatus according to claim 2, wherein the ammonia target value is a value output by the ammonia sensor under an air-fuel ratio of exhaust gas that is slightly richer than a stoichiometric air-fuel ratio.

4. The air-fuel ratio control apparatus according to claim 1, wherein the second feedback portion includes a control parameter setting portion that sets a control parameter of the air-fuel ratio on a basis of a result of a comparison between an output of the ammonia sensor and an ammonia target value, and the control parameter setting portion corrects the control parameter of the air-fuel ratio to a rich side when the output of the ammonia sensor is smaller than the ammonia target value.

5. The air-fuel ratio control apparatus according to claim 4, wherein the ammonia target value is a value output by the ammonia sensor under an air-fuel ratio of exhaust gas that is slightly richer than a stoichiometric air-fuel ratio.

6. The air-fuel ratio control apparatus according to claim 1, wherein the second feedback portion includes a comparison result reflection portion that feeds a result of a comparison between an output of the ammonia sensor and an ammonia target value back to the air-fuel ratio adjustment mechanism with a predetermined gain, and a gain setting portion that increases the predetermined gain as an amount of divergence of the output of the ammonia sensor from the ammonia target value increases.

7. The air-fuel ratio control apparatus according to claim 1, further comprising an operation state detection portion that detects an operation state of the internal combustion engine wherein the second feedback selection portion selects the second feedback portion as an actuation portion under fulfillment of a high-load operation condition, and selects the third feedback portion as an actuation portion under fulfillment of a low-load operation condition.

8. The air-fuel ratio control apparatus according to claim 7, wherein the second feedback portion performs the second feedback control such that the output of the ammonia sensor becomes close to an ammonia target value, the third feedback portion performs the second feedback control such that the output of the oxygen sensor becomes close to an oxygen target value, and the air-fuel ratio of exhaust gas is shifted from an air-fuel ratio of exhaust gas for making the output of the ammonia sensor coincident with the ammonia target value from an air-fuel ratio of exhaust gas for making the output of the oxygen sensor coincident with the oxygen target value in order to shift the air-fuel ratio of exhaust gas to a rich side of the target air-fuel ratio.

9. The air-fuel ratio control apparatus according to claim 1, further comprising a deviation direction determination portion that determines whether the air-fuel ratio of exhaust gas is deviant from a target air-fuel ratio to a rich side or a lean side, wherein the second feedback selection portion selects the second feedback portion as an actuation portion under a condition that it be determined that the air-fuel ratio of exhaust gas is deviant to the rich side, and selects the third feedback portion as an actuation portion under a condition that it be determined that the air-fuel ratio of exhaust gas is deviant to the lean side.

10. The air-fuel ratio control apparatus according to claim 9, wherein the deviation direction determination portion determines that the air-fuel ratio of exhaust gas is deviant from the target air-fuel ratio to the rich side when the output of the oxygen sensor is larger than an oxygen target value, and determines that the air-fuel ratio of exhaust gas is deviant from the target air-fuel ratio to the lean side when the output of the oxygen sensor is smaller than the oxygen target value.

11. The air-fuel ratio control apparatus according to claim 9, wherein the second feedback portion performs the second feedback control such that the output of the ammonia sensor becomes close to an ammonia target value, the third feedback portion performs the second feedback control such that the output of the oxygen sensor becomes close to an oxygen target value, and the air-fuel ratio of exhaust gas is shifted from an air-fuel ratio of exhaust gas for making the output of the ammonia sensor coincident with the ammonia target value from an air-fuel ratio of exhaust gas for making the output of the oxygen sensor coincident with the oxygen target value in order to shift the air-fuel ratio of exhaust gas to the rich side of the target air-fuel ratio.

12. The air-fuel ratio control apparatus according to claim 1, wherein the third feedback portion includes a control parameter setting portion that reflects a result of a comparison between an output of the oxygen sensor and an oxygen target value on a control parameter of the air-fuel ratio with a predetermined gain, and a gain setting portion that increases the predetermined gain as an amount of divergence of the output of the ammonia sensor from an ammonia target value increases.

* * * * *